US007194217B2

(12) United States Patent
Hosoi

(10) Patent No.: US 7,194,217 B2
(45) Date of Patent: Mar. 20, 2007

(54) IMAGE PROCESSING APPARATUS WITH SIMPLIFIED MODE SELECTION

(75) Inventor: Tetsuya Hosoi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 79 days.

(21) Appl. No.: 10/996,972

(22) Filed: Nov. 24, 2004

(65) Prior Publication Data

US 2005/0111894 A1 May 26, 2005

(30) Foreign Application Priority Data

Nov. 26, 2003 (JP) ..... 2003-396097

(51) Int. Cl.
*G03G 15/00* (2006.01)

(52) U.S. Cl. ..... 399/75; 399/371

(58) Field of Classification Search ..... 399/75–86, 399/370–371, 376, 45, 54, 59, 151, 205; 355/408, 55; 358/1.2, 1.5, 1.6, 2.1, 1.12; *G03G 15/00*
See application file for complete search history.

(56) References Cited

U.S. PATENT DOCUMENTS 4,743,944 A * 5/1988 Tomosada et al. ..... 399/86

2002/0030838 A1* 3/2002 Toyama et al.

FOREIGN PATENT DOCUMENTS

JP 11-308416 A 11/1999
JP 2000-033887 A 2/2000

* cited by examiner

*Primary Examiner*—Judy Nguyen
*Assistant Examiner*—N. Ha
(74) *Attorney, Agent, or Firm*—Akin Gump Strauss Hauer & Feld, LLP

(57) ABSTRACT

An image processing apparatus has a document table on which a document can be placed. A document position detector detects the position of the document on the document table. A scanning mode selector selects a scanning mode according to the position detected by the document position detector. A scanning unit scans the document in the selected mode. Different image processing modes may also be selected according to the detected position. The scanning and image processing modes are selected automatically, relieving the user of the need to make mode selections from a control panel.

16 Claims, 29 Drawing Sheets

FIG.2

| 21 NO. | 22 DOCUMENT POSITION (22-2) | 23 MODE SELECTION | | | | | 24 MODE DESCRIPTION |
|---|---|---|---|---|---|---|---|
| | | COLOR | | | RESOLUTION | | |
| | | FULL COLOR | GRAY-SCALE | BI-LEVEL | 300 dpi | 600 dpi | |
| 1 | DOC (22-1) | | ○ | | ○ | | 300 dpi, GRAYSCALE |
| 2 | DOC | | ○ | | ○ | | 300 dpi, GRAYSCALE, ENLARGE TO A3 SIZE |
| 3 | DOC | | | ○ | ○ | | 300 dpi, BI-LEVEL |
| 4 | DOC | ○ | | | ○ | | 300 dpi, FULL COLOR |
| 5 | DOC | | ○ | | | ○ | 600 dpi, GRAYSCALE |
| 6 | DOC | ○ | | | | ○ | 600 dpi, FULL COLOR |

FIG.3

| 31 | 32 |
|---|---|
| 1 | 300 dpi, GRAYSCALE |
| 2 | 300 dpi, GRAYSCALE, ENLARGE TO A3 SIZE |
| 3 | 300 dpi, BI-LEVEL |
| 4 | 300 dpi, FULL COLOR |
| 5 | 600 dpi, GRAYSCALE |
| 6 | 600 dpi, FULL COLOR |
| | |
| n-1 | 300 dpi, GRAYSCALE, REDUCE TO 50% |
| n | 300 dpi, GRAYSCALE, CENTER |

FIG.12

61 62

| DOCUMENT POSITIONS | MODE INFORMATION | | | |
|---|---|---|---|---|
| | 62-1 1ST DOCUMENT SIZE | 62-2 2ND DOCUMENT SIZE | 62-3 ZOOM MODE | 62-4 ZOOM RATIO |
| 61-5 61-4 61-3 61-2 61-1 1ST DOC 2ND DOC | A4 | A5 | A4 → A5 | 70 |
| 1ST DOC 2ND DOC | A4 | A5 | A4 →A5 | 70 |
| 1ST DOC 2ND DOC | A4 | B5 | A4 →B5 | 86 |
| 1ST DOC 2ND DOC | A5 | A4 | A5 →A4 | 141 |
| 1ST DOC 2ND DOC | A6 | A4 | A6 →A4 | 200 |
| | | | | |

| 61 | 61-1 | 61-2 | 61-4 | 61-5 | | | |
|---|---|---|---|---|---|---|---|
| DOCUMENT POSITIONS | 1ST DOCUMENT SIZE | 2ND DOCUMENT SIZE | ZOOM RATIO | SELECTED RESOLUTION | | | |
| | | | | 200dpi | 300dpi | 400dpi | 600dpi |
|   | A4 | A6 | 50% | 100dpi | 150dpi | 200dpi | 300dpi |
|   | A6 | A4 | 200% | 400dpi | 600dpi | 800dpi | 1200dpi |

| 21 NO. | 22 DOCUMENT POSITION (22-1, 22-3) | 23 MODE SELECTION | | | | | 24 MODE DESCRIPTION |
|---|---|---|---|---|---|---|---|
| | | COLOR | | | RESOLUTION | | |
| | | FULL COLOR | GRAY-SCALE | BI-LEVEL | 300 dpi | 600 dpi | |
| 1 |   | | ○ | | ○ | | 300 dpi, GRAYSCALE |
| 2 |   | | | ○ | ○ | | 300 dpi, BI-LEVEL |
| 3 |   | ○ | | | ○ | | 300 dpi, FULL COLOR |
| 4 |   | | ○ | | | ○ | 600 dpi, GRAYSCALE |
| | | | | | | | |

61 62

| DOCUMENT POSITIONS | ZOOM MODE EXAMPLE | | | |
|---|---|---|---|---|
| | 62-1 1ST DOCUMENT SIZE | 62-2 2ND DOCUMENT SIZE | 62-3 ZOOM MODE | 62-4 ZOOM RATIO |
|   | A4 | A5 | A4 → A5 | 70 |
|   | A4 | B5 | A4 →B5 | 86 |
|   | A5 | A4 | A5 →A4 | 141 |
| | | | | |

IMAGE PROCESSING APPARATUS WITH SIMPLIFIED MODE SELECTION

BACKGROUND OF THE INVENTION

1. Field of the Invention

The present invention relates to an image processing apparatus, more particularly to the selection of its operating modes.

2. Description of the Related Art

Examples of image apparatus to which the invention is applicable include facsimile machines, copiers, scanners, and multipurpose devices combining the functions of a scanner with the functions of a printer, facsimile machine, copier, etc. In conventional apparatus of this type, scanning and image processing mode settings such as the resolution, printing mode, and so on are set from a control panel before the scanning of a document begins. The document can then be scanned and image processing can be performed in a mode suited to the type of document, the purpose of the image processing, and the user's preferences. For the user, however, it is inconvenient to have to make the various mode settings from the control panel, particularly if the settings have to be made by complex button or key input procedures or by navigating through a complex set of menus.

Technology for setting the scanning mode and image processing mode automatically depending on whether the document is placed on a transparent document scanning table in the device or in an automatic document feeder (ADF) has been proposed in, for example, Japanese Unexamined Patent Application Number Nos. H11-308416 and 2000-33887. One scheme provides at least two scanning operation modes and changes the mode depending on whether the document is placed on the document scanning table or in the ADF; another scheme also takes the number of copies into consideration and varies the copy resolution according to the number of copies and whether the document is placed on the document scanning table or in the ADF.

These conventional schemes, however, provide only a very limited ability to select different scanning and image processing modes automatically; most mode settings still have to be made manually from the control panel. Moreover, these conventional schemes cannot be applied to an image processing apparatus in which the ADF is lacking or optional, or to an apparatus such as a facsimile machine in which all documents must be placed in the ADF.

SUMMARY OF THE INVENTION

An object of the present invention is to provide an image processing apparatus that can select a variety of different scanning modes and image processing modes without requiring the user to do anything more than place the document to be scanned in the apparatus.

Another object of the invention is to provide this capability in image processing apparatus lacking an ADF.

Another object is to provide this capability in image processing apparatus in which all documents must be placed in an ADF.

An image processing apparatus according to the present invention has a document table on which a document can be placed and a scanning unit that scans the document. A document position detector detects the position of the document on the document table. A mode selector selects different scanning modes or image processing modes according to the position detected by the document position detector. The apparatus then operates in the selected mode.

The size of the document, and the position and size of a sheet of recording media placed on the document table, may also be detected, and a zoom ratio selected as an image processing mode.

The document table may be either a transparent document scanning table or a table or tray in an ADF.

BRIEF DESCRIPTION OF THE DRAWINGS

In the attached drawings:

FIG. 2 shows an example of the selection of scanning modes and image processing modes according to document positions in the first embodiment;

FIG. 3 illustrates the data structure of the scanning modes and image processing modes in the first embodiment;

FIG. 12 shows an example of the selection of zoom modes according to document positions in the fifth embodiment;

DETAILED DESCRIPTION OF THE INVENTION

Figure 1:
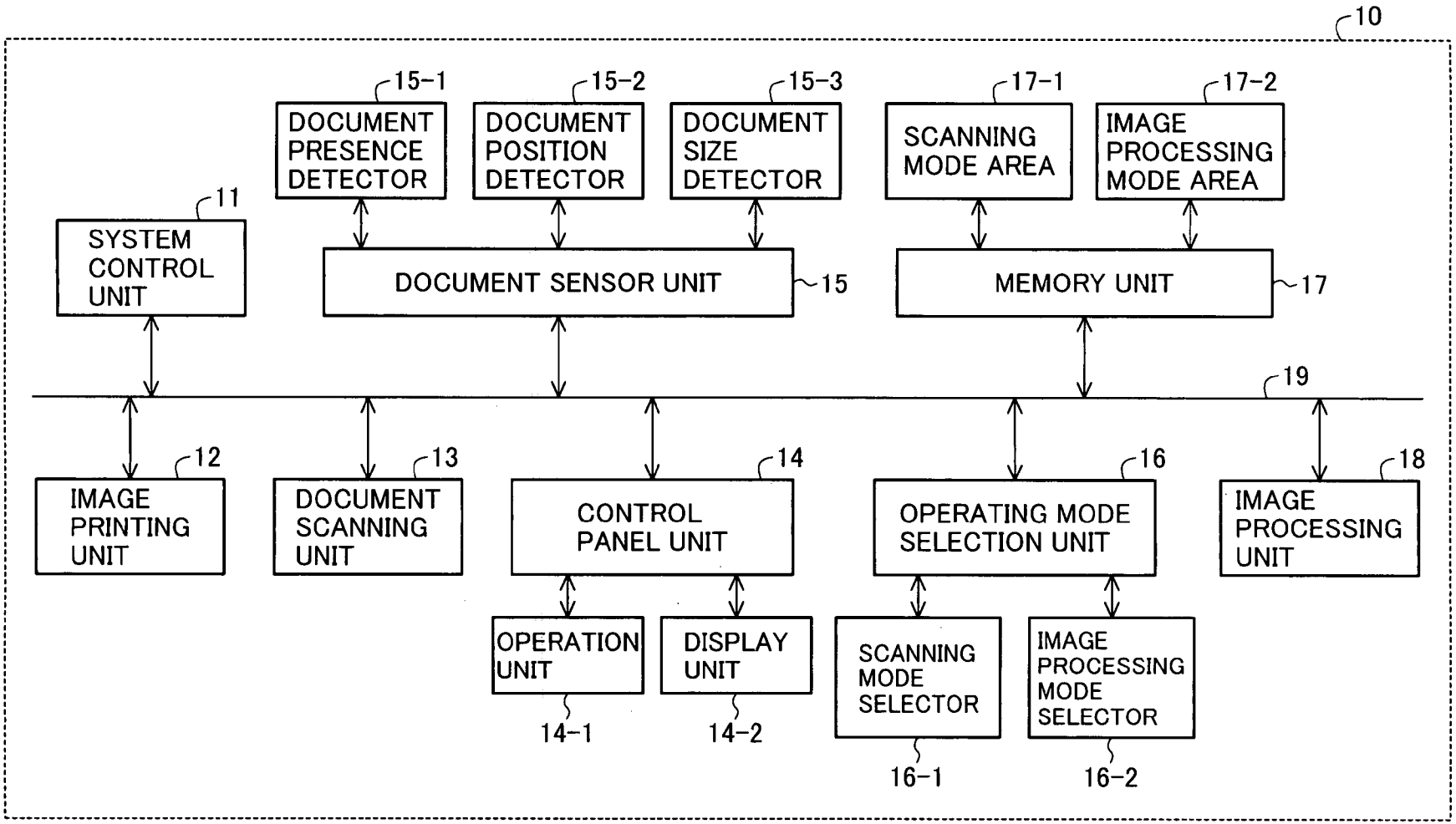
FIG. 1 is a block diagram of an image processing apparatus according to a first embodiment of the invention.

Embodiments of the invention will now be described with reference to the attached drawings, in which like elements are indicated by like reference characters.

The first embodiment is an image processing apparatus having at least scanning and printing functions. A document to be scanned is placed on a transparent document scanning table (a glass plate, also referred to below as a transparent table or simply as the document table). The document is scanned, image processing is carried out if necessary, and the scanned image is printed on a sheet of paper or other recording media, or sent to a host device such as a personal computer for storage, display, or transmission over a telecommunication line. The image processing apparatus can also print images received from the host device, and is accordingly a multipurpose device that can function as a scanner, copier, or printer. It will be assumed below that the image processing apparatus is capable of scanning and printing full-color images, bi-level monochrome (e.g., black-and-white) images, and multi-level monochrome (grayscale) images at a variety of resolutions.

Referring to FIG. 1, the main functional blocks of the image processing apparatus 10 include a system control unit 11, an image printing unit 12, a document scanning unit 13, a control panel unit 14, a document sensor unit 15, an operating mode selection unit 16, a memory unit 17, and an image processing unit 18. All of these units, including the image printing unit 12 and document scanning unit 13, are integrated within a single housing and are interconnected by a bus 19.

The system control unit 11 comprises, for example, a microprocessor or other computing device that manages the operation and status of the other component elements of the image processing apparatus 10 on an overall basis.

The image printing unit 12 prints scanned images, or images received from the host device (not shown), on paper or other recording media. The image printing unit 12 may use any of various known printing methods, including ink-jet, electrophotographic, and thermal transfer methods.

The document scanning unit 13 includes, for example, a traveling line scanner that scans documents placed on the document table.

The control panel unit 14 connects an operation unit 14-1 and a display unit 14-2, both of which are disposed in a housing panel (not shown) of the image processing apparatus 10, to the bus 19. The operation unit 14-1 is an input device such as a touch panel or a set of keys or buttons by which the user enters instructions and information. The display unit 14-2 is a display device such as a liquid crystal display or a light-emitting diode (LED) display, which is used for output of instructions and information to the user.

The document sensor unit 15 uses sensors such as photosensors (not shown) to obtain information about documents placed on the document table. This information is interpreted by a document presence detector 15-1, which detects the presence or absence of a document on the document table, a document position detector 15-2, which detects the position of the document on the document table, and a document size detector 15-3, which detects the size of the document.

The operating mode selection unit 16 receives information from the document sensing unit 15 indicating the position detected by the document position detector 15-2, and passes this information to a scanning mode selector 16-1 and an image processing mode selector 16-2, which select corresponding scanning and image processing modes. The operating mode selection unit 16 returns the selected mode information to the bus 19.

The memory unit 17 stores various information used in the image processing apparatus 10. In particular, the memory unit 17 has a scanning mode area 17-1 for storing scanning mode information referred to by the scanning mode selector 16-1, and an image processing mode area 17-2 for storing image processing mode information referred to by the image processing mode selector 16-2.

The image processing unit 18 performs processing such as centering and resizing on the scanned image data in the selected image processing mode.

The scanning mode and image processing mode are selected according to the position of the document placed on the document table as shown, for example, in FIG. 2. The document position pattern number column 21 in the table in FIG. 2 shows numbers assigned to predetermined document positions illustrated in the document position column 22. The document position column 22 shows a document (DOC) 22-1 placed on the document table or transparent table 22-2. The mode selection column 23 indicates available color and resolution mode settings, and indicates the settings selected corresponding to each of the numbered document positions. The mode description column 24 describes the selected scanning and image processing modes.

In document position pattern No. 1 in the table in FIG. 2, for example, the document 22-1 is aligned on the reference position at the far left corner of the transparent table 22-2 and is placed in the long edge feed (LEF) orientation, its long sides parallel with the main scanning direction. In document position pattern No. 6, the document 22-1 is aligned at the reference position in the far right corner of the transparent table 22-2 in the short edge feed (SEF) orientation, its short sides parallel with the main scanning direction. The mode settings selected in document position pattern No. 1 include grayscale and a resolution of three hundred dots per inch (300 dpi), so the selected scanning and image processing modes are 'grayscale with 300 dpi resolution'.

The scanning and image processing mode information is stored in the memory unit 17 in table form. For explanatory purposes, FIG. 3 shows an exemplary table storing both scanning and image processing mode information, although the scanning mode information and image processing mode information may of course be stored in separate areas 17-1, 17-2 as indicated in FIG. 1. The numbers 31 to the left of the mode table 32 in FIG. 3 correspond to the numbers in the document position pattern number column 21 in the table in FIG. 2, designating predetermined scanning and image processing modes. The number (n) of entries is equal to the number of predetermined modes. The mode table in FIG. 3 reproduces the information in the mode description column 24 in FIG. 2.

Next, the operation of the image processing apparatus 10 will be described. It will be assumed that the controls on the operation unit 14-1 are keys that may be depressed by the user, and that one of the keys is a start key. It will also be assumed that the image processing apparatus 10 does not perform other operations while in the standby state, but the same image scanning control is applicable while the image processing apparatus 10 is performing other operations if multitasking operation is allowed.

The operation starts with a display on the display unit 14-2 indicating that the image processing apparatus 10 is in the standby state. Next, the document presence detector 15-1 detects the presence or absence of a document by using, for example, several photosensors to determine whether a document 22-1 is present on the transparent table 22-2. If no document is present, then the operation unit 14-1 scans the states of the keys on the control panel by, for example, detecting electronic signals from key switches. If any key is currently depressed (down), conventional processing is carried out as designated by the key; descriptions of the processing will be omitted to avoid obscuring the invention with irrelevant detail. If no key is down, the document presence detector 15-1 detects the presence or absence of the document 22-1 again.

If a document 22-1 is present on the transparent table 22-2, then the document position detector 15-2 detects the position of the document by using, for example, several photosensors, and decides whether the document 22-1 is placed in one of the predetermined positions illustrated in the document position column in FIG. 2. If the document 22-1 is not placed in one of these predetermined positions, the key states in the operation unit 14-1 are scanned and processed as described above. If the document 22-1 is placed in one of the predetermined positions, the operating mode selection unit 16 selects a scanning mode and an image processing mode according to the table in FIG. 2. The display unit 14-2 displays the selected scanning and image processing modes for the user to confirm.

The operation unit 14-1 now scans the key states on the control panel to determine whether the start key is down. If the start key is down, the document scanning unit 13 scans the document 22-1, and the image processing unit 18 performs image processing if necessary. If some other key is down, conventional processing is performed as above. If no key is down, the document presence detector 15-1 detects the presence or absence of the document again. If the document is still present, the operation unit 14-1 scans the key states again, but if the document has been removed, the image processing apparatus 10 returns to the standby state.

Figure 4A:
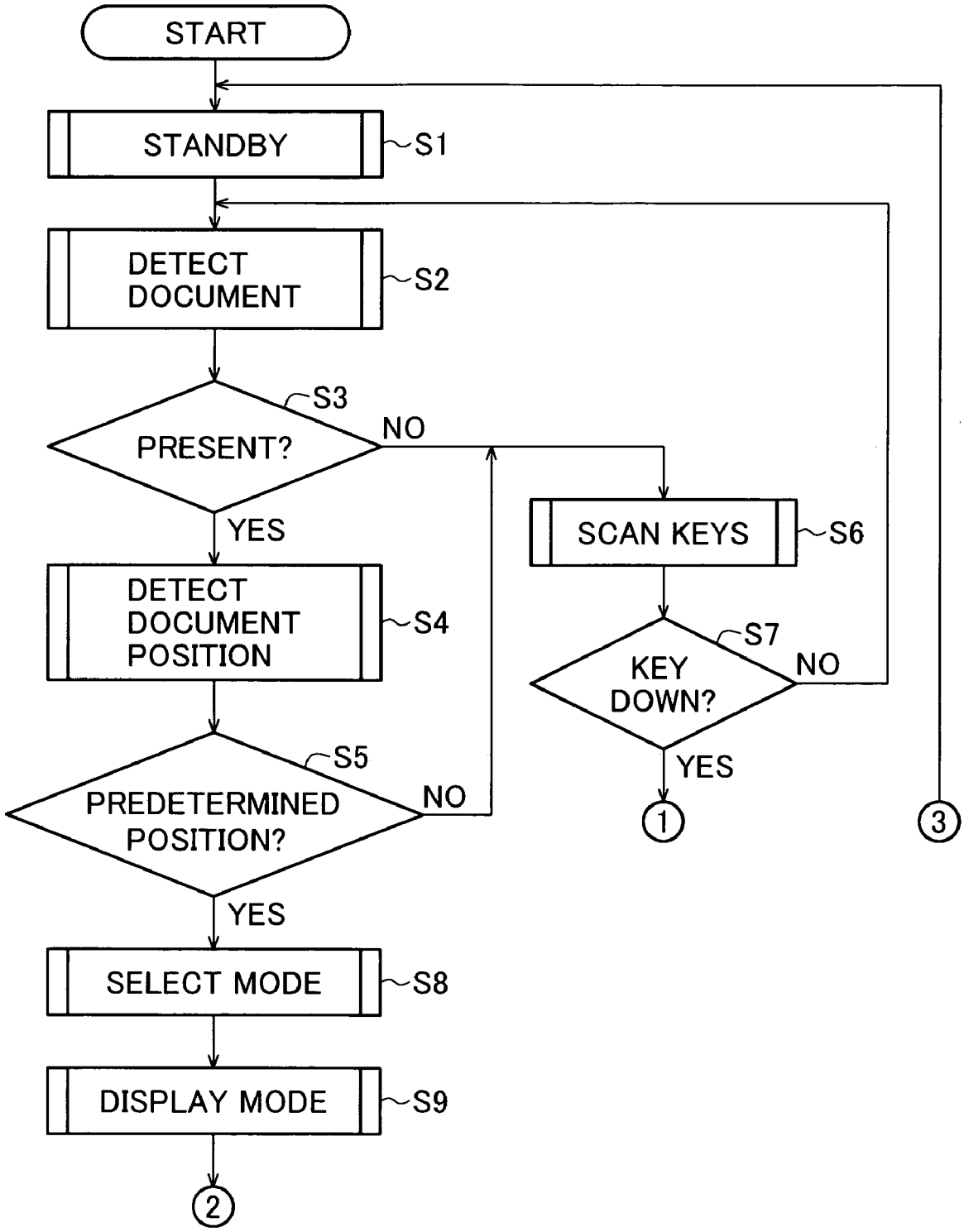
FIGS. 4A and 4B are a flowchart illustrating the operation of the image processing apparatus in the first embodiment.
Figure 4B:
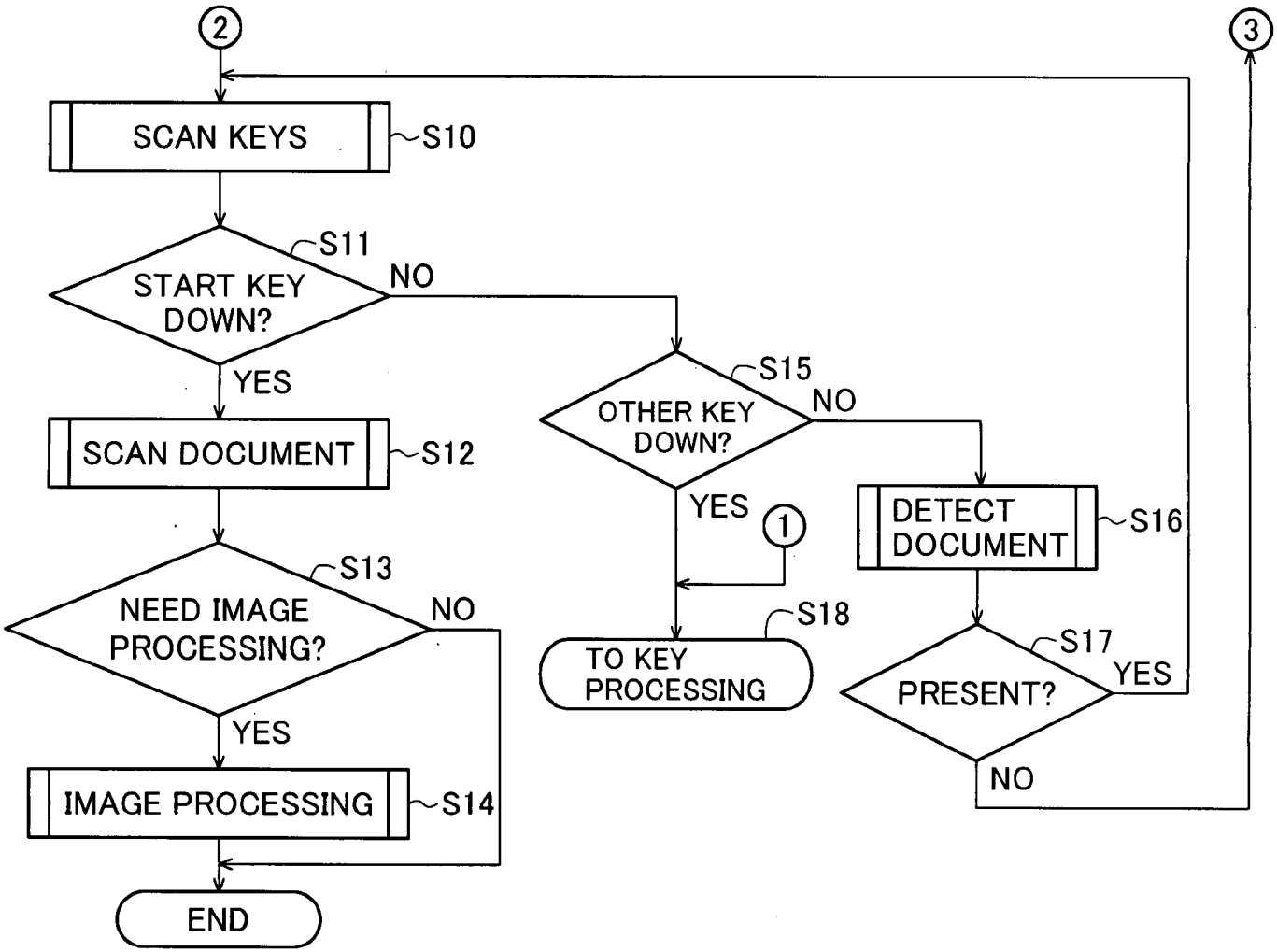

This procedure is illustrated in the flowchart in FIGS. 4A and 4B. In step S1 in FIG. 4A, an indication that the image processing apparatus 10 is in the standby state is displayed. Next, the presence or absence of a document on the transparent table 22-2 is sensed in step S2, and whether a document is present is determined from the sensor outputs in step S3. If a document 22-1 is present, its position is detected in step S4, and whether the document is disposed in one of the predetermined positions is determined in step S5. If no document is detected in step S3, or if the document position does not match any of the predetermined positions in step S5, the key states on the control panel are scanned in step S6 to determine in step S7 whether any key is down. If a key is down, processing for the key that is down is performed in step S18 in FIG. 4B; otherwise, the process returns to step S2 in FIG. 4A. If the document 22-1 is detected at one of the predetermined positions, then following step S5, the scanning and image processing modes corresponding to the document position are selected in step S8 and displayed on the display unit 14-2 in step S9.

In step S10 in FIG. 4B, the key states on the control panel are scanned to determine in step S11 whether the start key is down. If the start key is down, the document 22-1 is scanned in step S12 and whether image processing is necessary or not is determined in step S13. If image processing is not necessary, the process ends. If image processing is necessary, it is performed in step S14, and then the process ends. If the start key is not down in step S11, then whether any other key is down is determined in step S15. If no other key is down, the presence or absence of the document 22-1 on the transparent table 22-2 is sensed in step S16 and determined in step S17. If the document 22-1 is still present, the process returns to step S10; if the document is now absent, the process returns to step S1 in FIG. 4A. If another key is down in step S15, processing for that key is performed in step S18.

As described above, according to the first embodiment, since scanning and image processing modes are assigned to each predetermined position of the document 22-1 on the transparent table 22-2, the user can select a scanning mode and image processing mode simply by placing the document 22-1 in one of these predetermined positions, without having to press keys or navigate through menus on the control panel. The operation of the image processing apparatus is therefore simplified, time is saved, and incomplete or forgotten settings of the scanning and image processing modes are avoided. Moreover, a comparatively large number (n) of different modes are selectable in this way, even though the image processing apparatus 10 has only a single document table 22-2 and no ADF.

Next, a second embodiment of the invention will be described. The second embodiment is identical to the first embodiment except for the way in which modes are assigned to document positions.

Figure 5:
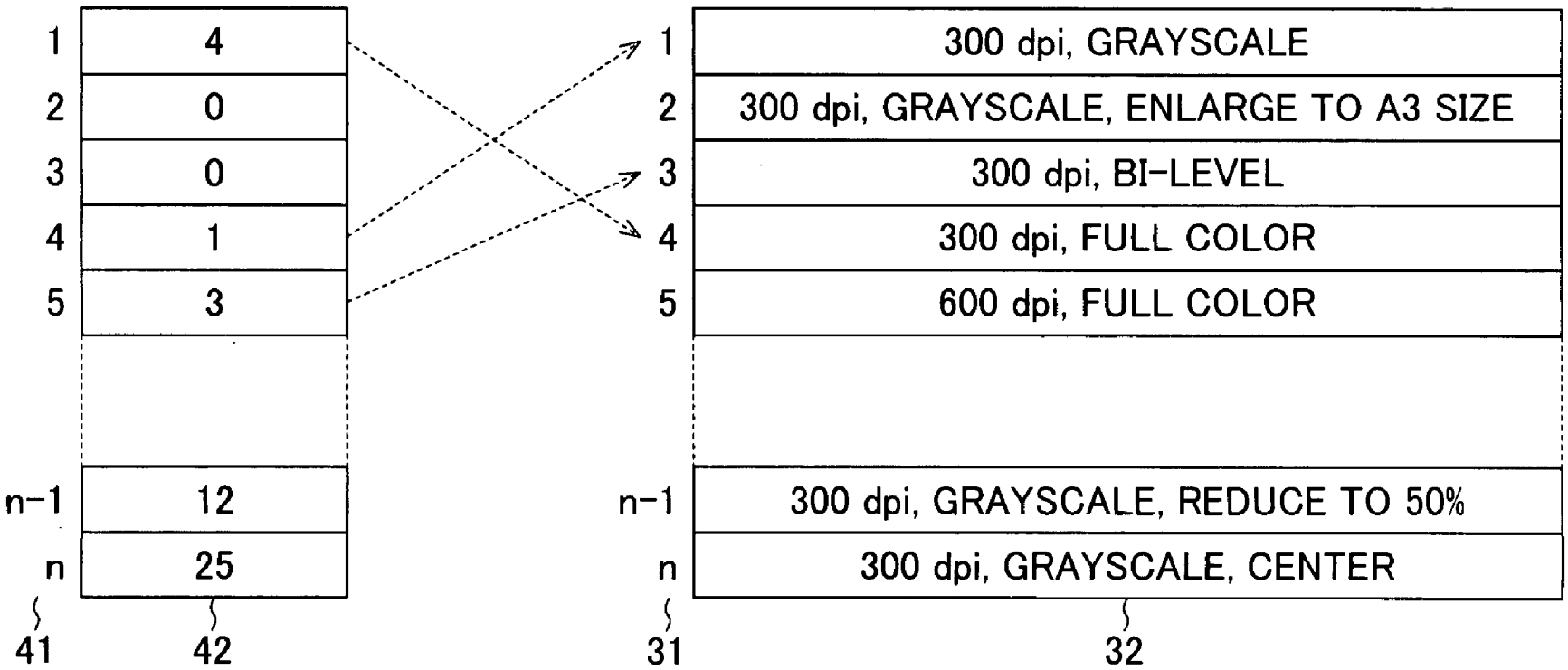
FIG. 5 illustrates the data structure of the scanning modes and image processing modes in a second embodiment.

The scanning and image processing modes corresponding to different document positions were pre-assigned in the first embodiment, but they can be flexibly reassigned in the second embodiment. In the second embodiment, the scanning and image processing mode information is stored in the memory unit 17 in a table data structure combining a document position pattern table 42 with a table 32 of predetermined scanning and image processing modes, as shown in FIG. 5. The mode table 32 in FIG. 5 is identical to the table 32 shown in FIG. 3 in the first embodiment, so a repeated description will be omitted.

The predetermined entries in the mode table 32 are numbered by mode numbers 31 from one to n. The entries in the document position pattern table 42 numbered by position numbers 41 from one to n. The entries stored in the document position pattern table 42 are mode numbers 31 in the table 32, establishing a pointer correspondence between the document positions and the scanning and image processing modes. The first entry in the document position pattern table 42, for example, is '4', indicating the fourth entry (full color with 300 dpi resolution) in the mode table 32.

Next, the operation by which the user selects the scanning and image processing modes corresponding to different document positions will be described. Other operations in the second embodiment are the same as in the first embodiment, so descriptions will be omitted. It will be assumed that the operation unit 14-1 has numeric keys and an end key.

To start the operation, a screen prompting the user to input a position number 41 in the document position pattern table 42 is displayed on the display unit 14-2, and the operation unit 14-1 scans the key states on the control panel until the user enters a valid position number 41, designating one of the predetermined document positions indicated in FIG. 2, or depresses the end key. If the user depresses the end key, the process ends. If the user enters a valid position number 41, a predetermined list of scanning and image processing modes is displayed on the display unit 14-2. The operation unit 14-1 now scans the key states until the user enters a valid number designating one of the displayed scanning and image processing modes. This mode number is stored in the entry selected by the position number 41 in the document position pattern table 42.

Figure 6:
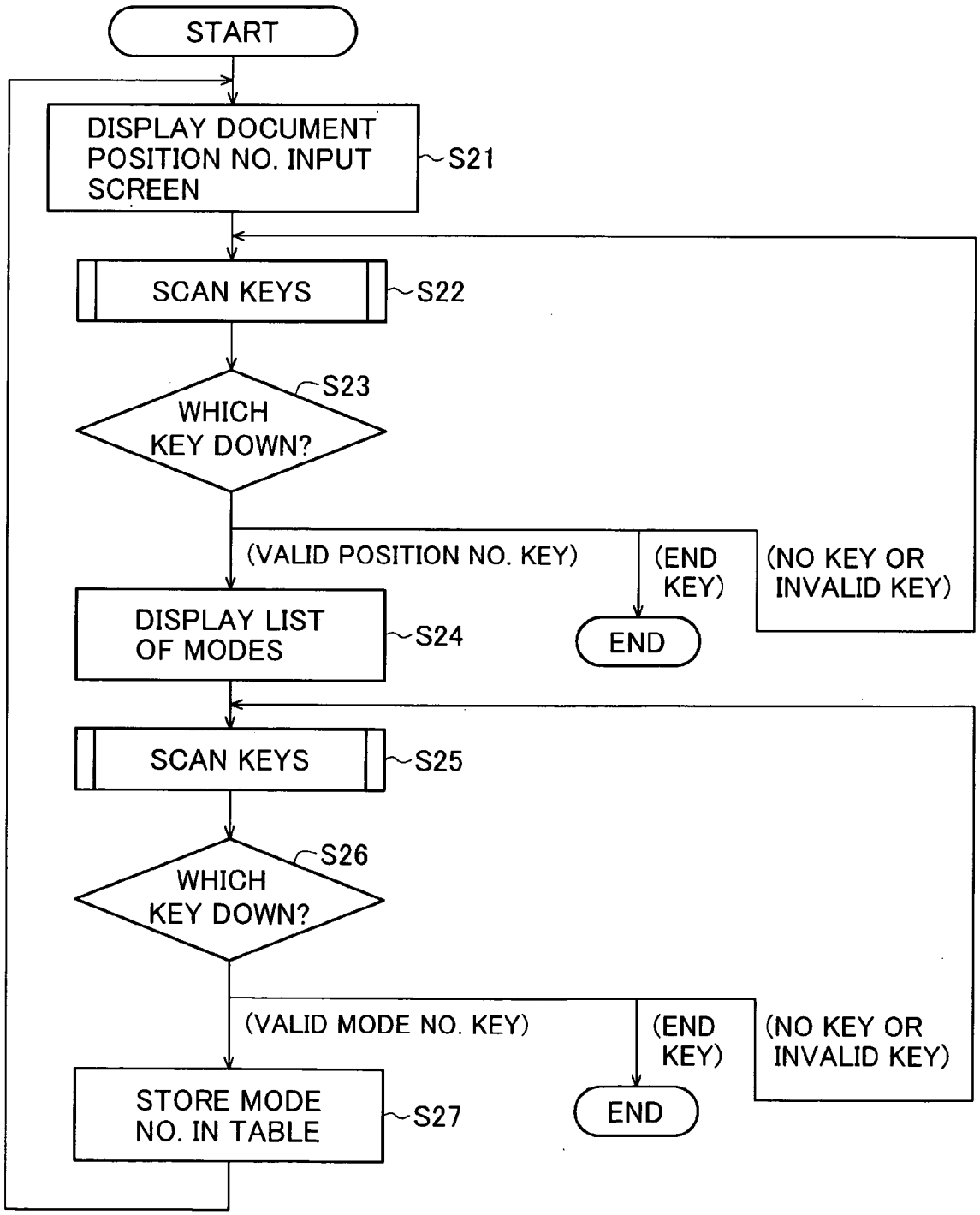
FIG. 6 is a flowchart illustrating the operation of the image processing apparatus in the second embodiment.

The above procedure is illustrated in the flowchart in FIG. 6. A screen prompting for input of a position number 41 is displayed on the display unit 14-2 in step S21, and the key states on the control panel are scanned in step S22 to determine in step S23 which key is down. If the end key is down, the process ends. If no key is down or an invalid key is down, the process returns to the step S22 above. If a numeric key validly designating one of the predetermined document placement positions is down, a list of predetermined scanning and image processing modes, numbered according to their mode numbers 31 in the table 32, is displayed on the display unit 14-2 in step S24, and the user is prompted for input of a number from the list. Key states on the control panel are then scanned in step S25 to determine in step S26 which key is down. If a key indicating a valid mode number 31 is down, the mode number 31 is stored in the entry selected by the position number 41 in the document position pattern table 42 in step S27. If the end key is down, the process ends. If no key is down or an invalid key is down, the process returns to step S25 above.

As described above, the second embodiment gives the user the flexibility to reassign the scanning and image processing modes corresponding to different document positions. Therefore, the most frequently used scanning and image processing modes can be assigned to the most convenient document positions, simplifying the operation of the image processing apparatus for the user or group of users who use the apparatus, thereby reducing document setting mistakes.

Next, a third embodiment of the invention will be described.

In the second embodiment, the scanning and image processing modes corresponding to the document positions were selected from a predetermined list. In the third embodiment, the user is free to designate arbitrary scanning and image processing modes, instead of having to select predetermined modes from a list. The scanning and image processing modes in the third embodiment are stored in the memory unit 17 in the table data structure shown in FIG. 7. The scanning and image processing modes that were stored as single entries in the second embodiment (FIG. 5) are separated into individual items such as resolution and color representation in the table in FIG. 7.

Figure 7:
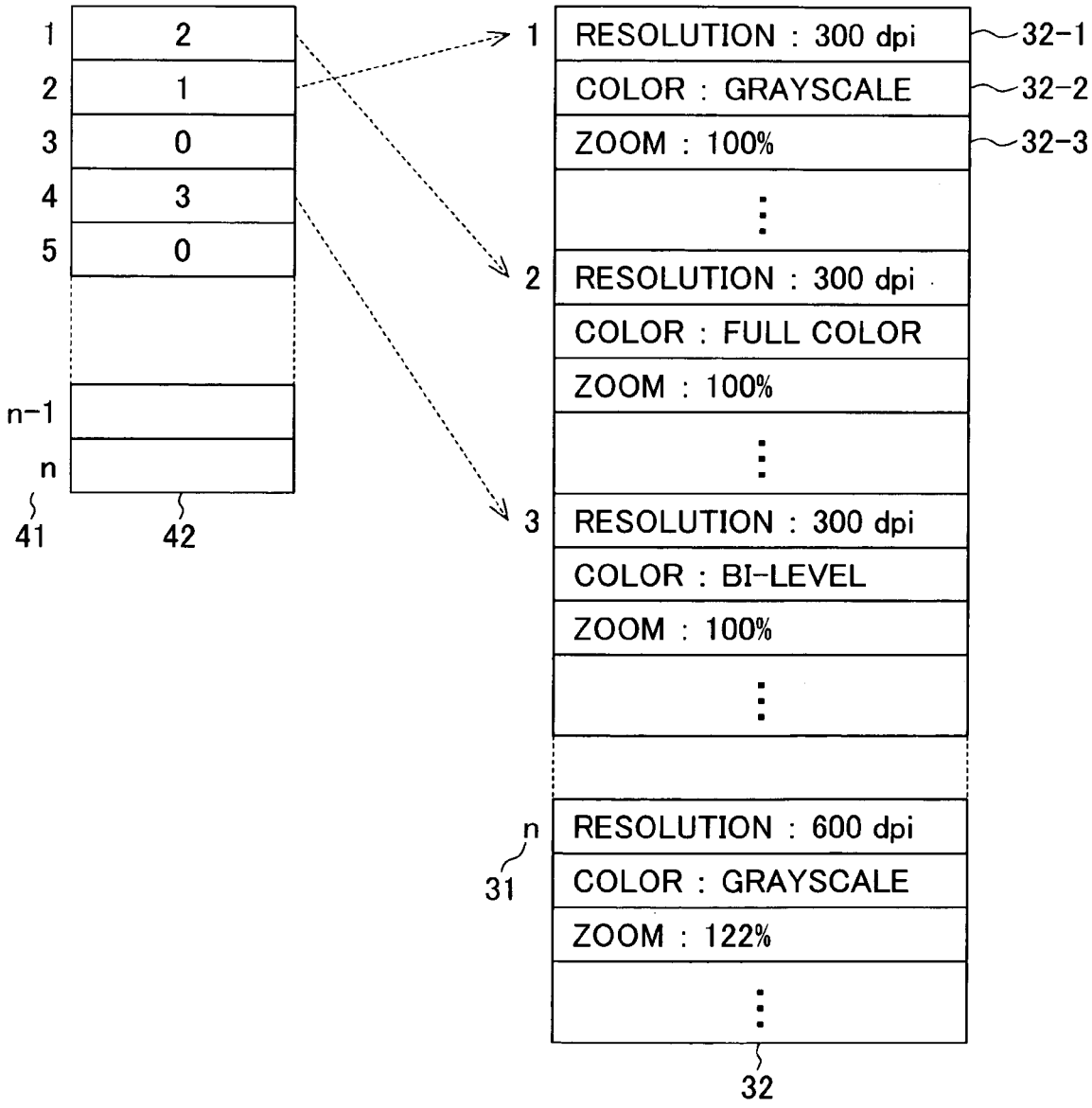
FIG. 7 illustrates the data structure of the scanning modes and image processing modes in a third embodiment.

The mode numbers 31 shown to the left of the mode table 32 in FIG. 7 are accordingly block numbers, each designating a block of individual items of mode setting information, such as resolution information 32-1, color representation information 32-2, zoom ratio information 32-3, and so on. As in the second embodiment, the numbers 41 to the left of the document position pattern table 42 correspond to the n predetermined document positions, and the entries stored in the document position pattern table 42 are mode numbers 31, establishing a pointer correspondence between document positions and scanning and image processing modes. The first entry stored in the document position pattern table 42 in FIG. 7, for example, is '2'; the corresponding scanning and image processing mode includes a resolution of 300 dpi, full color representation, and a zoom ratio of 100%.

Next, the operations by which the user defines the scanning and image processing modes will be described. Other operations in the third embodiment, including the operations by which the user assigns the defined scanning and image processing modes to different document positions, are the same as in the first and second embodiments, so descriptions will be omitted.

First, a screen asking the user to select a block in the mode table 32 shown in FIG. 7 is displayed on the display unit 14-2. The operation unit 14-1 scans the key states on the control panel until the user enters a valid block number 31 or depresses the end key. If the user depresses the end key, the process ends.

When the user enters a valid block number 31, a numbered list of resolutions is displayed on the display unit 14-2. For example, resolutions of 600 dpi (No. 1 on the list), 300 dpi (No. 2 on the list), and so on may be displayed. Next, the operation unit 14-1 scans the key states on the control panel. If the end key is down, the process ends, but if a numeric key indicating one of the resolution selection numbers (e.g., 1 or 2) is down, the corresponding resolution information 32-1 is stored in the selected block in the mode table 32.

Next, a numbered list of color representation selections is displayed on the display unit 14-2. For example, full color (No. 1), grayscale (No. 2), and so on may be displayed. The operation unit 14-1 scans the key states on the control panel. If the end key is down, the process ends, but if a numeric key indicating one of the color representation numbers (e.g., 1 or 2) is down, the corresponding color representation information 32-2 is stored in the selected block in the mode table 32.

As the next mode selection item, a numbered list of zoom ratios is displayed on the display unit 14-2. For example, 100% (No. 1), 50% (No. 2), and so on may be displayed. The operation unit 14-1 again scans the key states on the control panel. If the end key is down, the process ends, but if a numeric key indicating one of the zoom ratio selection numbers (e.g., 1 or 2) is down, the corresponding zoom ratio information 32-3 is stored in the selected block in the mode table 32.

If there are other mode items, they are similarly displayed, selected, and stored in the mode table 32. The scanning and image processing modes are thus defined and stored on an item-by-item basis.

Figure 8A:
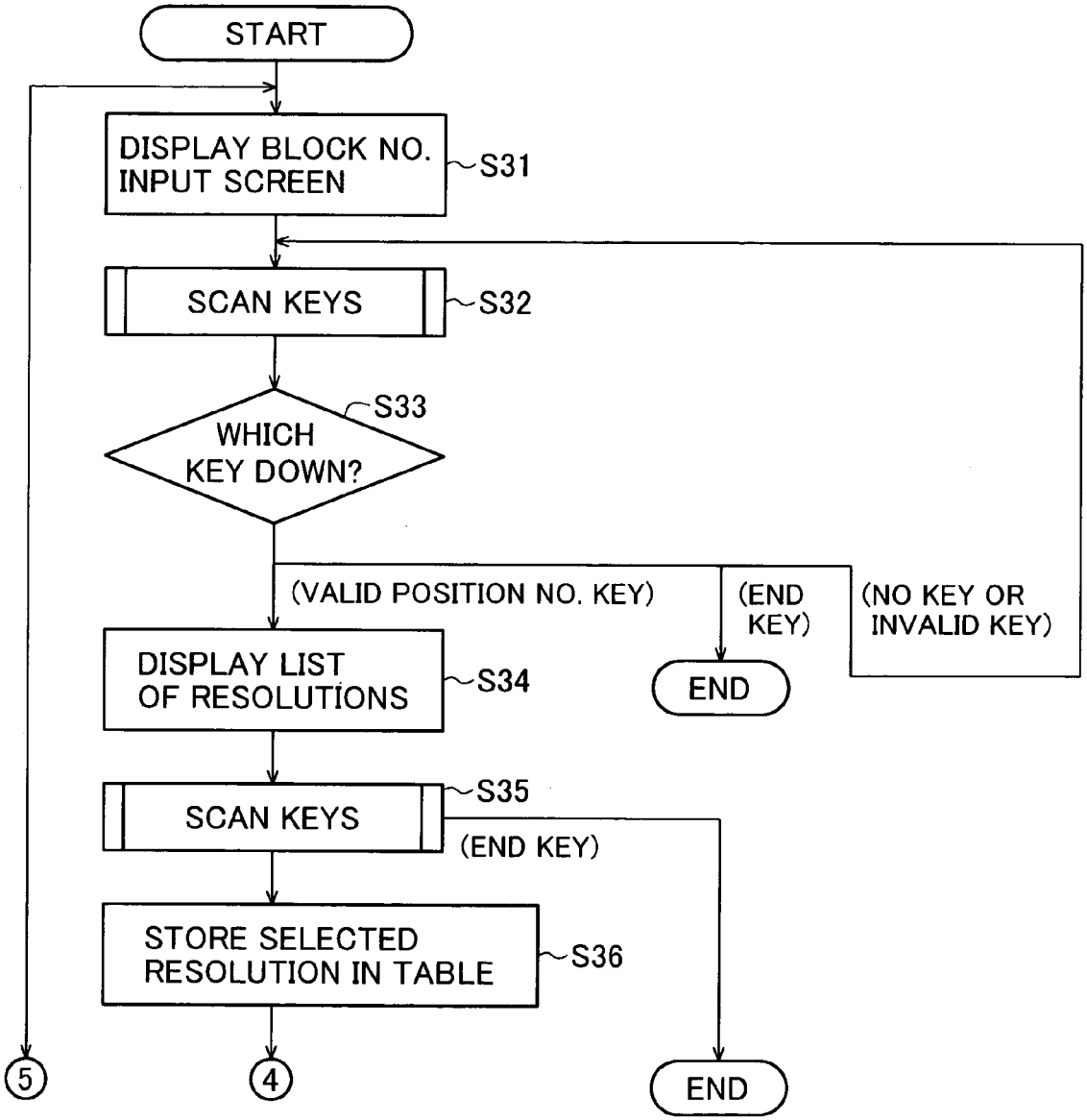
FIGS. 8A and 8B are a flowchart illustrating the operation of the image processing apparatus in the third embodiment.
Figure 8B:
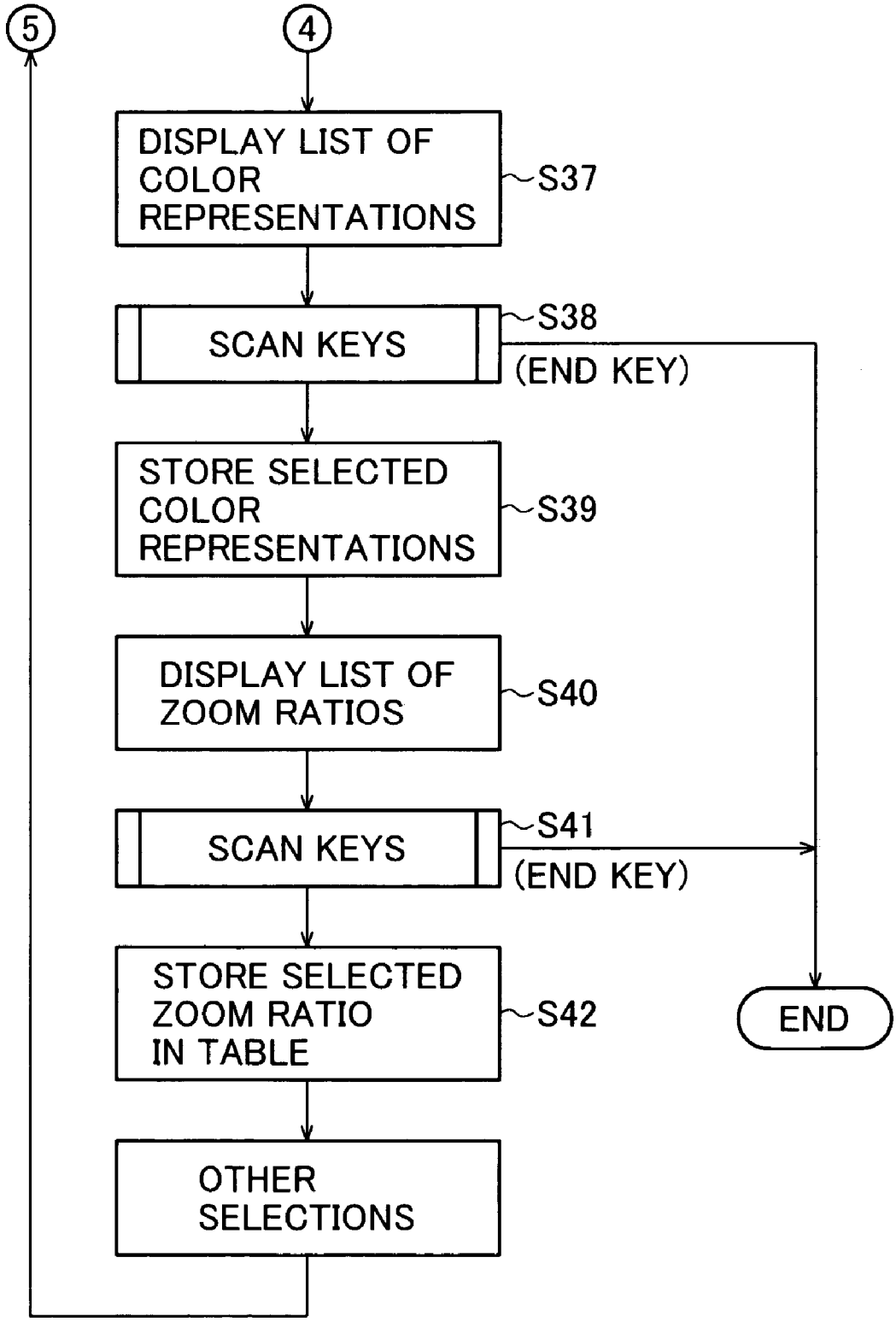

This procedure is illustrated in the flowchart in FIGS. 8A and 8B. In step S31 in FIG. 8A, a screen prompting the user to input one of the block numbers 31 in the table 32 of scanning and image processing modes is displayed on the display unit 14-2. The key states on the control panel are scanned in step S32 to determine in step S33 which key is down. If the end key is down, the process ends. If no key is down or an invalid key is down, the process returns to step S32. If a valid key indicating one of the block numbers 31 in the table 32 of scanning and image processing modes is down, a numbered list of resolution selections is displayed in step S34, and the key states are scanned again in step S35. If the user depresses end key, the process ends; if the user presses a numeric key indicating the number of one of the resolution selections, the resolution information corresponding to that number is stored in the resolution item area in the table 32 of scanning and image processing modes in step S36.

A numbered list of color representation selections is now displayed in step S37 in FIG. 8B, and the key states are scanned in step S38. If the user depresses end key, the process ends; if the user presses a numeric key indicating the number of one of the color representation selections, the corresponding color representation information is stored in the table 32 of scanning and image processing modes in step S39. Next, a numbered list of zoom ratio selections is displayed in step S40, and the key states are scanned in step S41. If the user depresses end key, the process ends; if the user presses a numeric key indicating the number of one of the listed zoom ratios, the corresponding zoom ratio information is stored in the table 32 of scanning and image processing modes in step S42.

As described above, the third embodiment allows the user to define the values of the items constituting each scanning and image processing mode. The user can accordingly define a set of scanning and image processing modes tailored to the user's environment: for example, tailored to the preferences of the group of people who use the image processing apparatus 10, the convenience and usability of which is thereby further improved.

Next, a fourth embodiment of the invention will be described.

Figure 9:
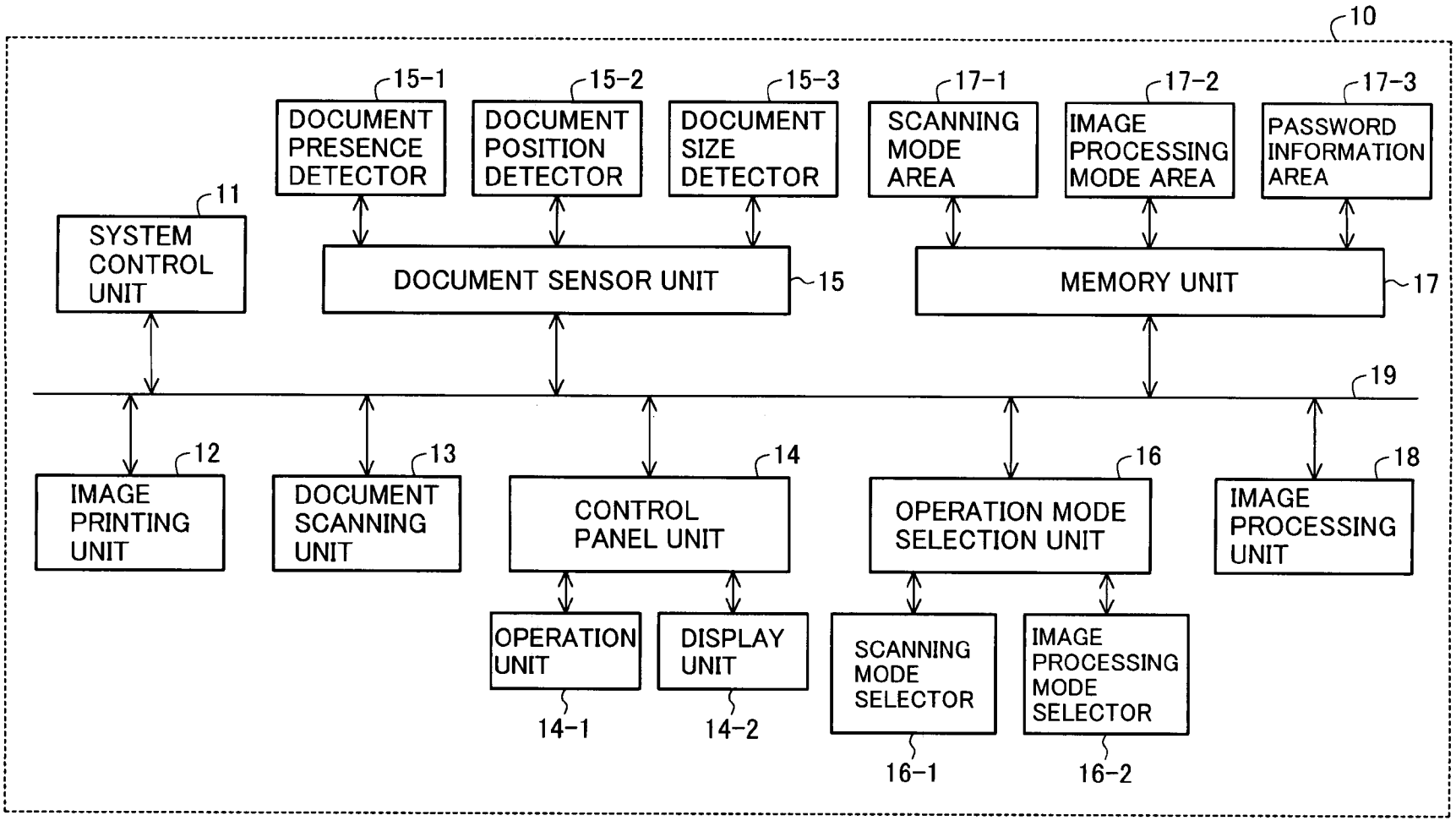
FIG. 9 is a block diagram of an image processing apparatus according to a fourth embodiment.

FIG. 9 is a block diagram of the image processing apparatus according to the fourth embodiment of the invention.

In the second and third embodiments, the scanning and image processing modes assigned to different document positions can be altered easily, by any user. The fourth embodiment prevents such unregulated reassignment of the scanning and image processing modes. More specifically, the fourth embodiment offers password protection, if desired, for the scanning and image processing mode assignments made in the second embodiment.

In the image processing apparatus 10 according to the fourth embodiment, a password information area 17-3 that stores password information is added to the memory unit 17. Except for this point, the image processing apparatus 10 in the fourth embodiment has the same structure as in the first embodiment described above, so repeated descriptions will be omitted. The password information stored in the password information area 17-3 is a multiple-digit number similar to, for example, the well-known personal identity numbers used to protect financial cards.

Next, the password protection operation in the fourth embodiment will be described.

When a user attempts to assign scanning and processing modes to document positions, or to change existing assignments, the system control unit 11 first determines whether a password is stored in the password information area 17-3 or not. If a password is stored, a screen prompting for input of the password is displayed on the display unit 14-2. When the user enters a password, the input password is compared with the stored password. If the input password does not match the stored password, a message indicating a wrong password is displayed on the display unit 14-2 for a predetermined time, after which the screen prompting for password input is displayed again. If the input password matches the stored password, then the user can proceed to assign scanning and image processing modes by the procedure shown in FIG. 6 in the second embodiment.

If no password is stored in the password information area 17-3, a message asking whether to store a password to protect the forthcoming settings of the scanning and image processing modes is displayed on the display unit 14-2. The operation unit 14-1 scans the key states on the control panel until the user depresses a key. If a key indicating that the user does not desire password protection is down, the scanning and image processing modes can then be freely assigned by the procedure shown in FIG. 6.

If a key indicating that the user desires password protection is down, a screen prompting for password input is displayed on the display unit 14-2. The password must satisfy predetermined syntax rules as to length and content. If the user enters a password that violates the predetermined rules, the password is discarded as invalid and a message asking for password re-entry is displayed on the display unit 14-2 for a predetermined time, followed by redisplay of the password entry screen.

When the password has been entered in accordance with the predetermined rules, the password information is stored in the password information area 17-3. The user can then proceed to assign scanning and image processing modes as in FIG. 6.

Figure 10:
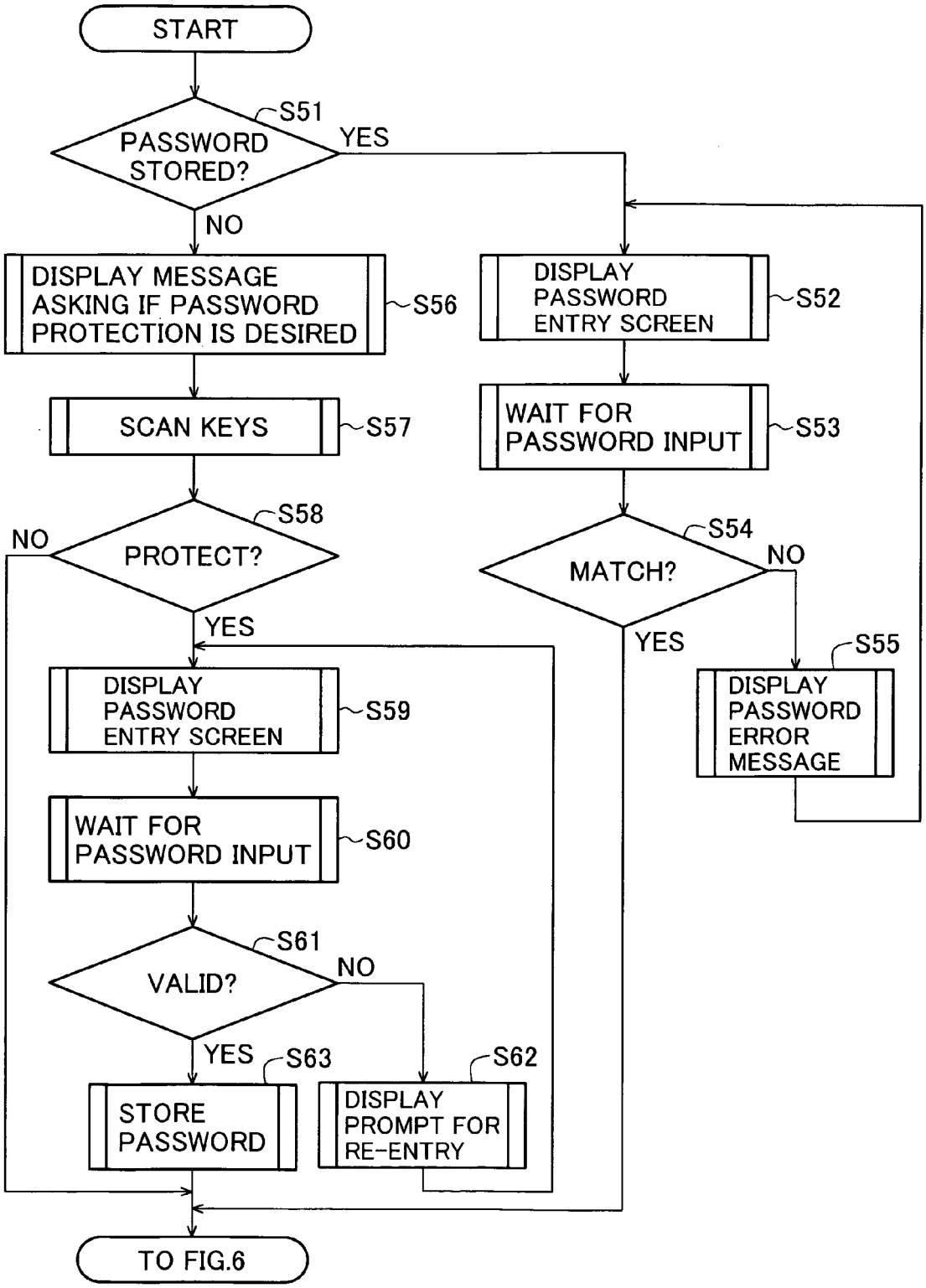
FIG. 10 is a flowchart illustrating the operation of the image processing apparatus in the fourth embodiment.

This procedure is illustrated in the flowchart in FIG. 10. In step S51, whether a password is already stored in the password information area 17-3 or not is determined. If a password is stored, a screen prompting for password input is displayed on the display unit 14-2 in step S52, and processing waits until the user enters a password in step S53. It is then determined in step S54 whether the input password matches the stored password or not. If the two passwords match, the process proceeds to step S21 in FIG. 6; otherwise, a message indicating a password error is displayed for a predetermined time in step S55, after which the process returns to step S52. If it is found in step S51 that a password is not already stored, a message asking whether to store a password to protect the scanning and image processing mode assignments or not is displayed in step S56. The key states on the control panel are then scanned in step S57 to decide in step S58 whether to apply password protection or not. If password protection is not applied, the process proceeds to step S21 in FIG. 6; otherwise, a password entry screen is displayed on the display unit 14-2 in step S59 and processing waits until the user enters a password in step S60. In step S61, the password syntax is checked. If the password has not been input in accordance with the predetermined rules, a message indicating that the password is invalid and re-entry is required is displayed for a predetermined time in step S62, after which the process returns to step S59. If the password has been input in accordance with the predetermined rules, the password information is stored in the password information area 17-3 in step S63, and the reassignment process described in the second embodiment begins from step S21 in FIG. 6.

As described above, in the fourth embodiment, when scanning and image processing modes are assigned to document positions, the assignments can be protected by a password, so that they cannot be changed by a person who does not know the password. Therefore, a system can be constructed in which, for example, only a system administrator can alter the scanning and image processing modes. Confusion caused by unregulated reassignment of the scanning and image processing modes can thereby be avoided, leading to a reduction in the number of retries due to improper scanning and image processing.

In a variation of the fourth embodiment, similar password protection is provided for the scanning and image processing mode definitions made in the third embodiment.

Next, a fifth embodiment of the invention will be described.

In the fifth embodiment, first and second documents are placed on the document table; the first document is scanned, and the scanned image is enlarged or reduced to the size of the second document. The second document may be a blank sheet of paper or other recording media.

Figure 11:
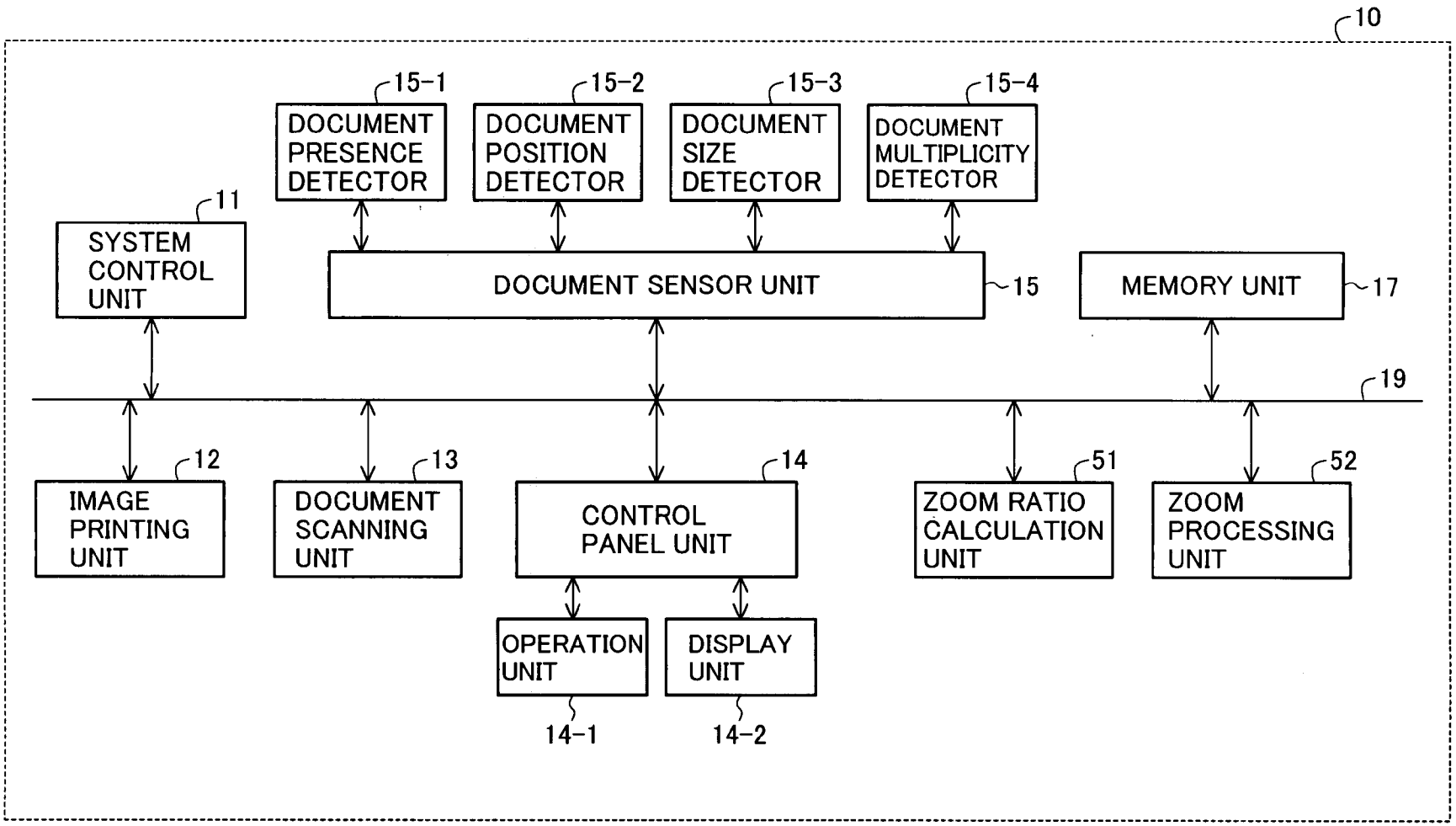
FIG. 11 is a block diagram of an image processing apparatus according to a fifth embodiment.

As shown in FIG. 11, the image processing apparatus 10 according to the fifth embodiment adds a document multiplicity detector 15-4 that detects the number of documents to the document sensor unit 15 in the first embodiment. The image processing apparatus 10 in the fifth embodiment also includes a zoom ratio calculation unit 51 that calculates the zoom ratio from the first document size to the second document size and a zoom processing unit 52 that performs processing such as image density conversion, and does not include the operating mode selection unit, image processing unit, scanning mode area and image processing mode area that were present in the preceding embodiments.

As shown in FIG. 12, the image processing apparatus 10 in the fifth embodiment selects a zoom ratio according to the sizes of documents placed in fixed positions on the document table. In the document position column 61, the first document 61-1, which is the document to be scanned, is aligned with the reference position 61-2 in the far left corner and the second document 61-3, which indicates the desired size after zooming, is aligned with the reference position 61-4 at the far right corner on the transparent table 61-5. These positions form predetermined patterns. The document sizes and zoom ratios are indicated in the mode information column 62, which includes a first document size column 62-1, second document size column 62-2, zoom mode column 62-3, and zoom ratio column 62-4.

For example, if it is detected that the first document 61-1 is A4-size (210 millimeters×297 millimeters) and second document 61-3 is A5-size (148 millimeter×210 millimeters), then the zoom mode is an A4-to-A5 size reduction with a zoom ratio of 70%. Both the zoom mode and ratio are thus determined from the sizes of the first document 61-1 and second document 61-3.

Next, the operation of the fifth embodiment will be described.

It will be assumed that the image processing apparatus 10 does not perform other operations while in the standby state, but the same image scanning control is applicable while the image processing apparatus 10 performs other operations if multitasking operation is allowed.

First, an indication that the image processing apparatus 10 is in the standby state is displayed on the display unit 14-2. Next, the document presence detector 15-1 detects the presence or absence of a document on the transparent table 61-5. If no document is present, then the operation unit 14-1 scans the key states on the control panel. If no key is down, the document presence detector 15-1 detects the presence or absence of a document again. If a key is down, processing corresponding to the key that is down is performed.

If a document is present, then the document multiplicity detector 15-4 detects the number of documents to determine whether two documents are present. If only one document is present, or if three or more documents are present, normal image scanning control is carried out. If two documents are present, the document position detector 15-2 detects the positions of the two documents. If the two documents are not placed in accordance with one of the predetermined positional patterns, the process ends with the display of a message requesting repositioning of the documents. If the two documents are placed in accordance with one of the predetermined positional patterns, the document size detector 15-3 detects the size of the second document 61-3. If the size of the second document does not match the size of the recording media loaded in a media cassette (not shown) in the image processing apparatus 10, the process ends with the display of a message requesting loading of recording media with the same size as the second document 61-3.

If recording media of the same size as the second document 61-3 are present in the cassette, the document size detector 15-3 detects the size of the first document 61-1. From the sizes of the first document 61-1 and second document 61-3, the zoom ratio calculation unit 51 calculates a zoom ratio, and the calculated zoom ratio is displayed on the display unit 14-2 together with the sizes of the first document 61-1 and second document 61-3 for the user to confirm. The operation unit 14-1 then scans the key states on the control panel. If the start key is down, the scanning unit 13 scans the first document, and if the zoom ratio is not 100%, the zoom processing unit 52 carries out the necessary zoom processing to enlarge or reduce the size of the scanned image.

If the start key is not down but another key is down, appropriate processing is performed. If no key is down, the document presence detector 15-1 detects document presence again and the process returns to the standby state if all documents have been removed. If a document is present, the document multiplicity detector 15-4 again detects the number of documents. If only one document is present, or three or more documents are present, the process returns to the standby state because the number of the documents (previously determined to be two) has been changed. If two documents are still present, the operation unit 14-1 scans the key states as described above, and scanning and zooming proceed if the start key has been depressed.

Figure 13A:
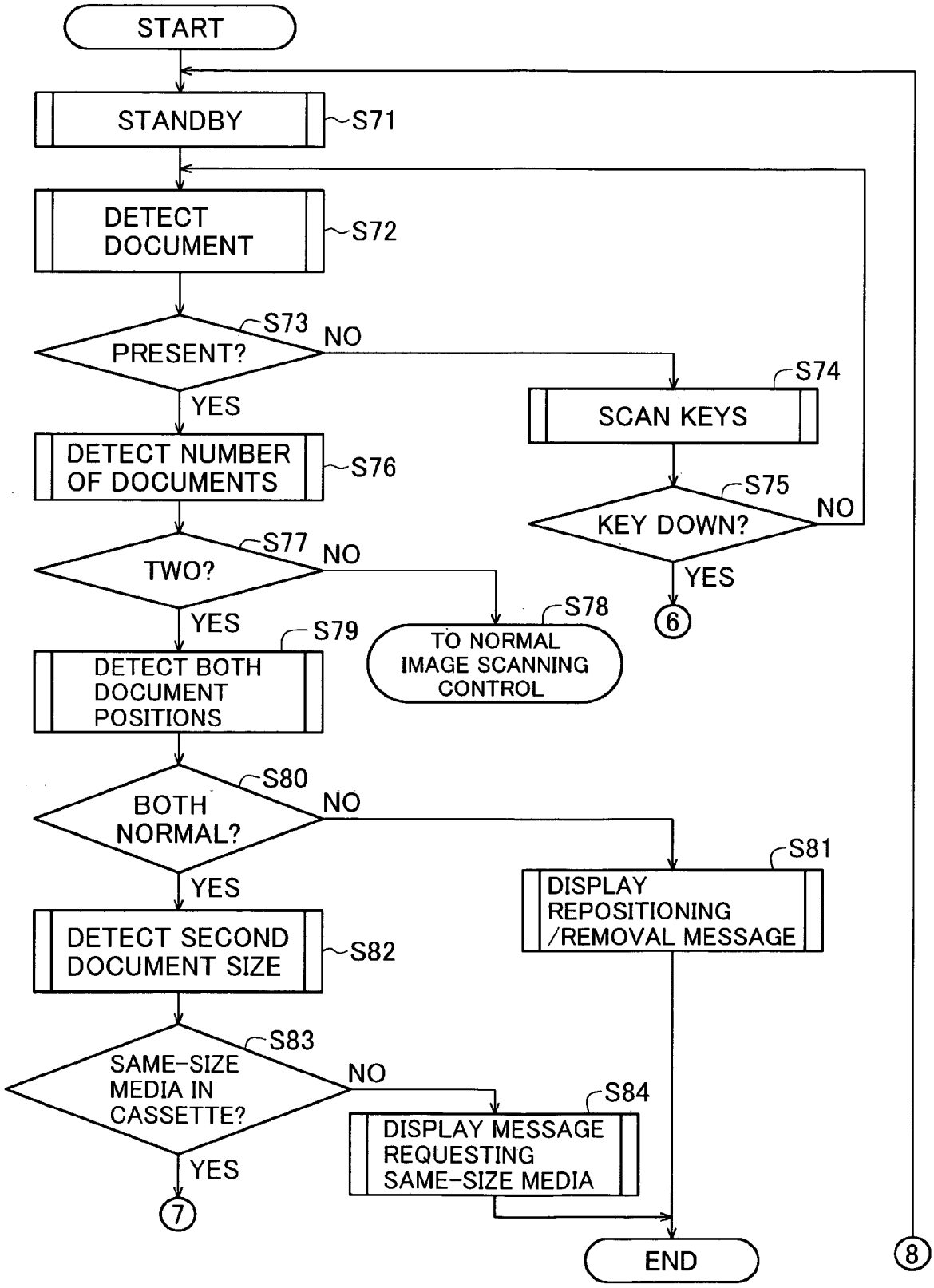
FIGS. 13A and 13B are a flowchart illustrating the operation of the image processing apparatus in the fifth embodiment.
Figure 13B:
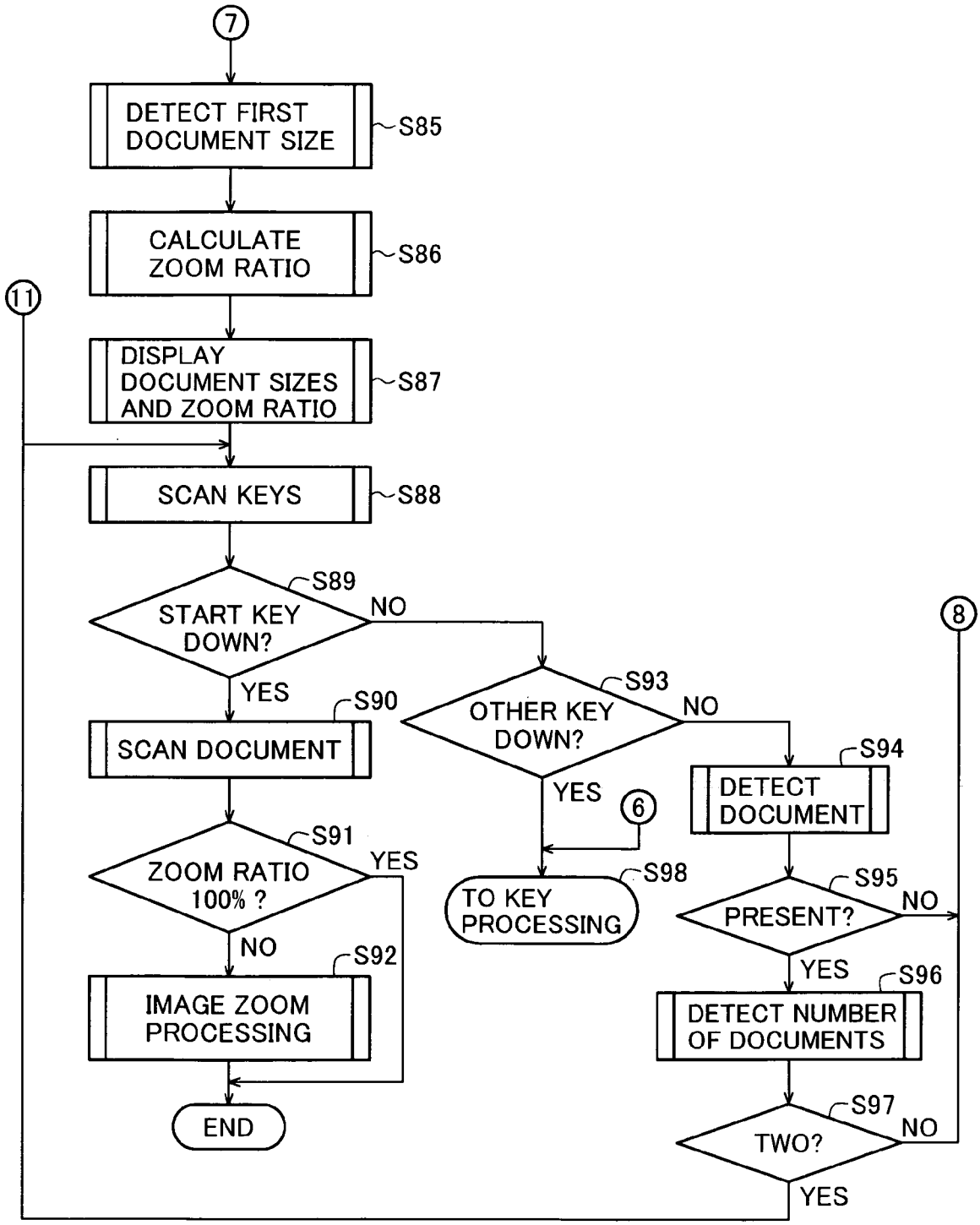

The above procedure is illustrated in the flowchart in FIGS. 13A and 13B. In step S71 in FIG. 13A, an indication that the image processing apparatus 10 is in the standby state is displayed. Next, the presence or absence of a document on the transparent table 61-5 is sensed in step S72, and whether a document is present is determined in step S73. If no document is detected, the key states on the control panel are scanned in step S74 to determine in step S75 whether any key is down. If a key is down, processing for the key that is down is performed in step S98 in FIG. 13B; otherwise, the process returns to step S72 in FIG. 13A. If a document is detected in step S73, the number of documents is detected in step S76 to decide in step S77 whether two documents are present. If there is only one document, or there are three or more documents, the process proceeds to normal image scanning control in step S78. If there are two documents, the positions of the two documents are detected in step S79. In step S80, it is decided whether the two documents are placed in accordance with the predetermined reference positions. If they are not, a message requesting repositioning of the two documents is displayed on the display unit 14-2 in step S81, and the process ends. If the two documents are placed in accordance with the predetermined reference positions, the size of the second document 61-3 is detected in step S82. In step S83, it is determined whether recording media of the same size as the second document 61-3 are loaded in the cassette or not. If they are not, a message requesting loading of media of the same size as the second document 61-3 is displayed on the display unit 14-2 in step S84, and the process ends.

If recording media of the same size are loaded in the cassette, the size of the first document 61-1 is detected in step S85 in FIG. 13B. In step S86, a zoom ratio is calculated from the sizes of the first document 61-1 and second document 61-3. The calculated zoom ratio is then displayed on the display unit 14-2 together with the sizes of the first document 61-1 and second document 61-3 in step S87 for the user to confirm. Next, the key states on the control panel are scanned in step S88 to determine in step S89 whether the start key is down. If the start key is down, the document is scanned in step S90, and whether the zoom ratio is 100% or not is determined in step S91. If the zoom ratio is 100%, the process ends; otherwise, image zooming processing is performed in step S92, and then the process ends. If the start key is not down in step S89, then whether any other key is down or not is determined in step S93. If another key is down, processing for that key is performed in step S98; otherwise, the presence or absence of a document on the transparent table 61-5 is sensed in step S94 to determine in step S95 whether a document is present. If no document is detected, the process returns to step S71 in FIG. 13A. If a document is present, the number of documents present is detected in step S96 to determine in step S97 whether two documents are present. If there are two documents, the process returns to step S88 in FIG. 13B. If there is only one document, or three or more documents, the process returns to step S71 in FIG. 13A.

In the above description, the reference positions at which the first document 61-1 and second document 61-3 must be placed are fixed, but in a variation of the fifth embodiment, the reference positions can be altered as in the second embodiment, and the alterations can be protected with a password as in the fourth embodiment.

As described above, according to the fifth embodiment, two documents, i.e., a first document 61-1 and a second document 61-3, are placed on the transparent table 61-5, and the first document 61-1 is scanned and then zoomed to the size of the second document 61-3, whereby the user does not have to set the zoom ratio manually. Advantages for the user include simplified operation, greater convenience, less time, and fewer mistakes, since the second document 61-3 lets the user picture the zooming operation visually instead of having to specify it by a number.

Next, a sixth embodiment of the invention will be described.

Like the fifth embodiment, the sixth embodiment zooms a first document to the size of a second document placed on the same document table, but in the sixth embodiment, the size of the second document and the calculated zoom ratio are stored in the memory unit 17, so that if the first document has multiple pages, the second document only has to be placed on the document table together with the first page of the first document; the second document does not have to be present on the document table while the second and subsequent pages of the first document are scanned.

Figure 14:
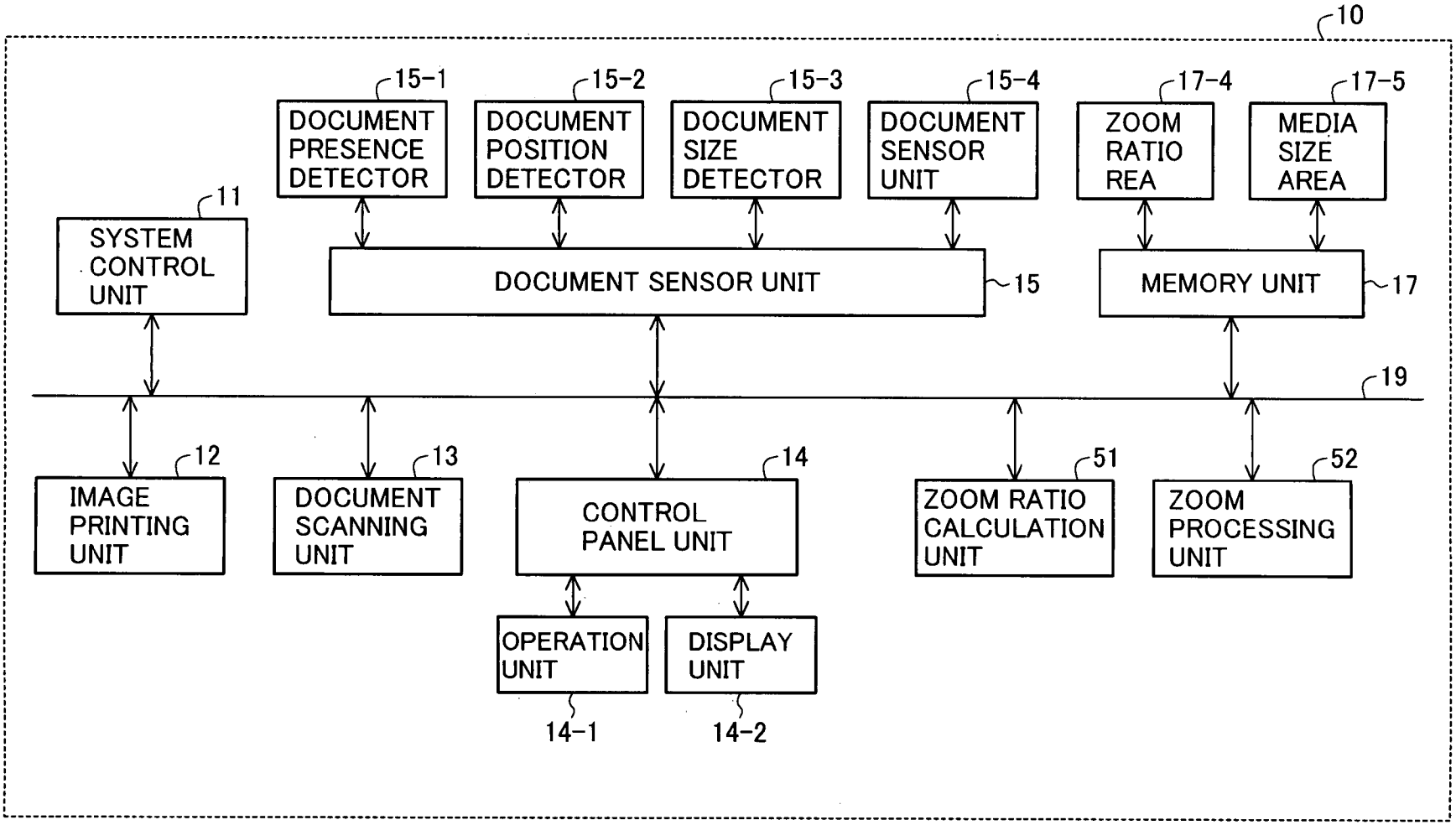
FIG. 14 is a block diagram of an image processing apparatus according to a sixth embodiment.

Referring to FIG. 14, the image processing apparatus 10 according to the sixth embodiment adds a zoom ratio area 17-4 that stores the zoom ratio from the size of the first document to the size of the second document and a media size area 17-5 that stores the size of the second document to the memory unit 17 in the fifth embodiment. The other constituent elements of the sixth embodiment are the same as in the fifth embodiment, so descriptions will be omitted.

Next, the operation of the image processing apparatus 10 in the sixth embodiment will be described.

First, an indication that the image processing apparatus 10 is in the standby state is displayed on the display unit 14-2. Next, the document presence detector 15-1 detects the presence or absence of a document on the document table. If no document is present, then the operation unit 14-1 scans the key states on the control panel. If a key is down, appropriate processing is performed. If no key is down, the document presence detector 15-1 detects the presence or absence of the document again.

If a document is present, then the document multiplicity detector 15-4 detects the number of documents present. If three or more documents are present, the process ends with the display of a message on the display unit 14-2, requesting repositioning or removal of the documents. If only one document is present, and if a zoom ratio is already stored in the zoom ratio area 17-4, indicating that the document is a second or subsequent page of the first document 61-1, the document position detector 15-2 detects the position of the first document 61-1. If the first document 61-1 is aligned with the predetermined reference position, the process enters the procedure shown in FIG. 13B in the fifth embodiment at the point where the operation unit 14-1 scans the key states on the control panel, and image scanning proceeds if the start key is down. Otherwise, the process ends with the display of a message requesting repositioning of the document.

If two documents are present, the document position detector 15-2 detects their positions. If the two documents are not aligned with the predetermined reference positions, the process ends with the display of a message requesting repositioning of the documents. If the documents are aligned with the predetermined reference positions, the document size detector 15-3 detects the size of the second document 61-3. If the size of the second document 61-3 does not match the size of the recording media loaded in the media cassette (not shown) in the image processing apparatus 10, the process ends with the display of a message requesting loading of recording media with the same size as the second document 61-3.

If recording media of the same size as the second document 61-3 are present in the cassette, the size of the second document 61-3 is stored in the media size area 17-5 and then the document size detector 15-3 detects the size of the first document 61-1. From the sizes of the first document 61-1 and second document 61-3, a zoom ratio is calculated and the calculated zoom ratio is stored in the zoom ratio area 17-4. The zoom ratio and the sizes of the first document 61-1 and second document 61-3 are displayed on the display unit 14-2 for the user to confirm. The process then enters the procedure shown in FIG. 13B in the fifth embodiment to initiate image scanning when the start key is depressed.

Figure 15A:
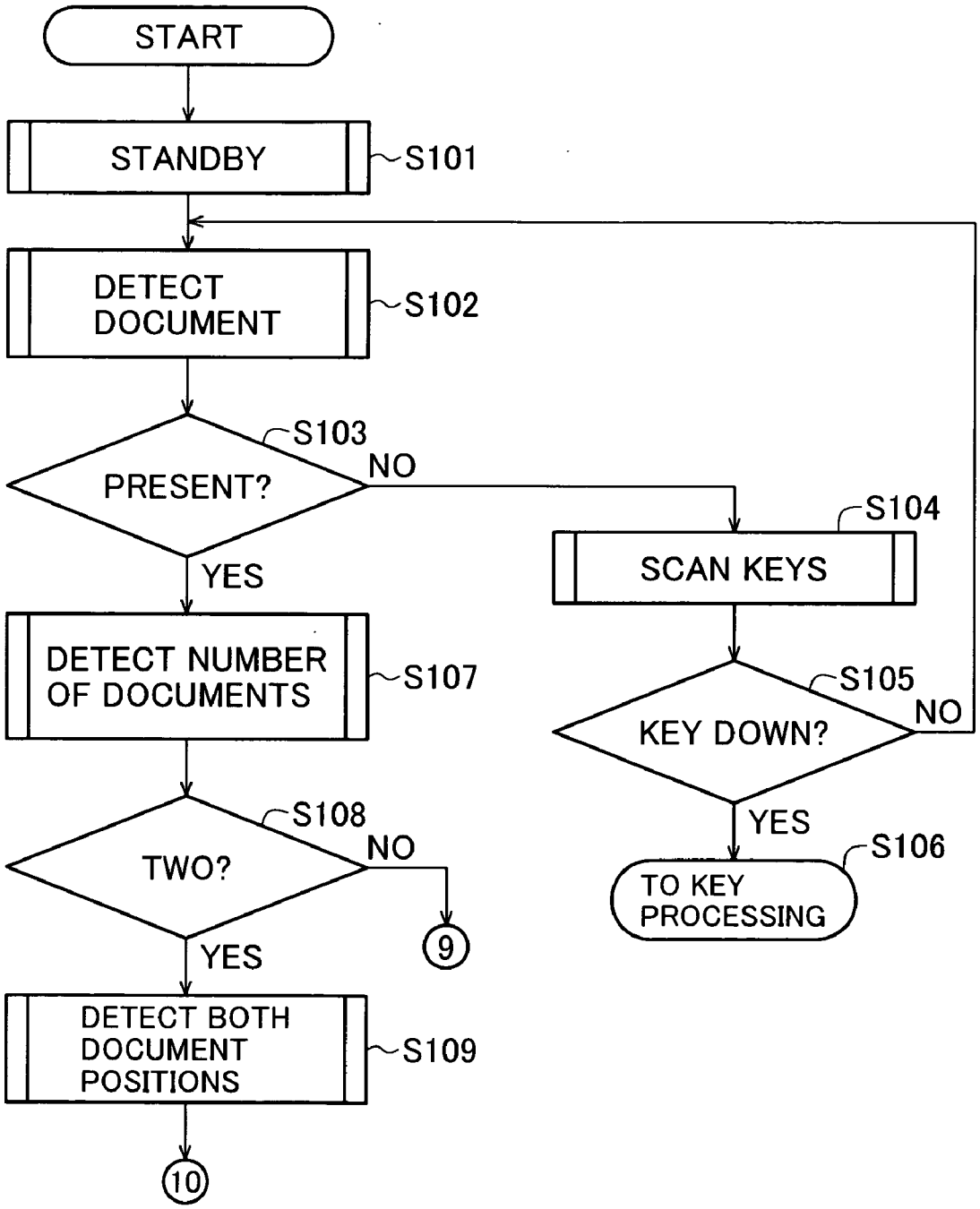
FIGS. 15A, 15B, and 15C are a flowchart illustrating the operation of the image processing apparatus in the sixth embodiment.
Figure 15B:
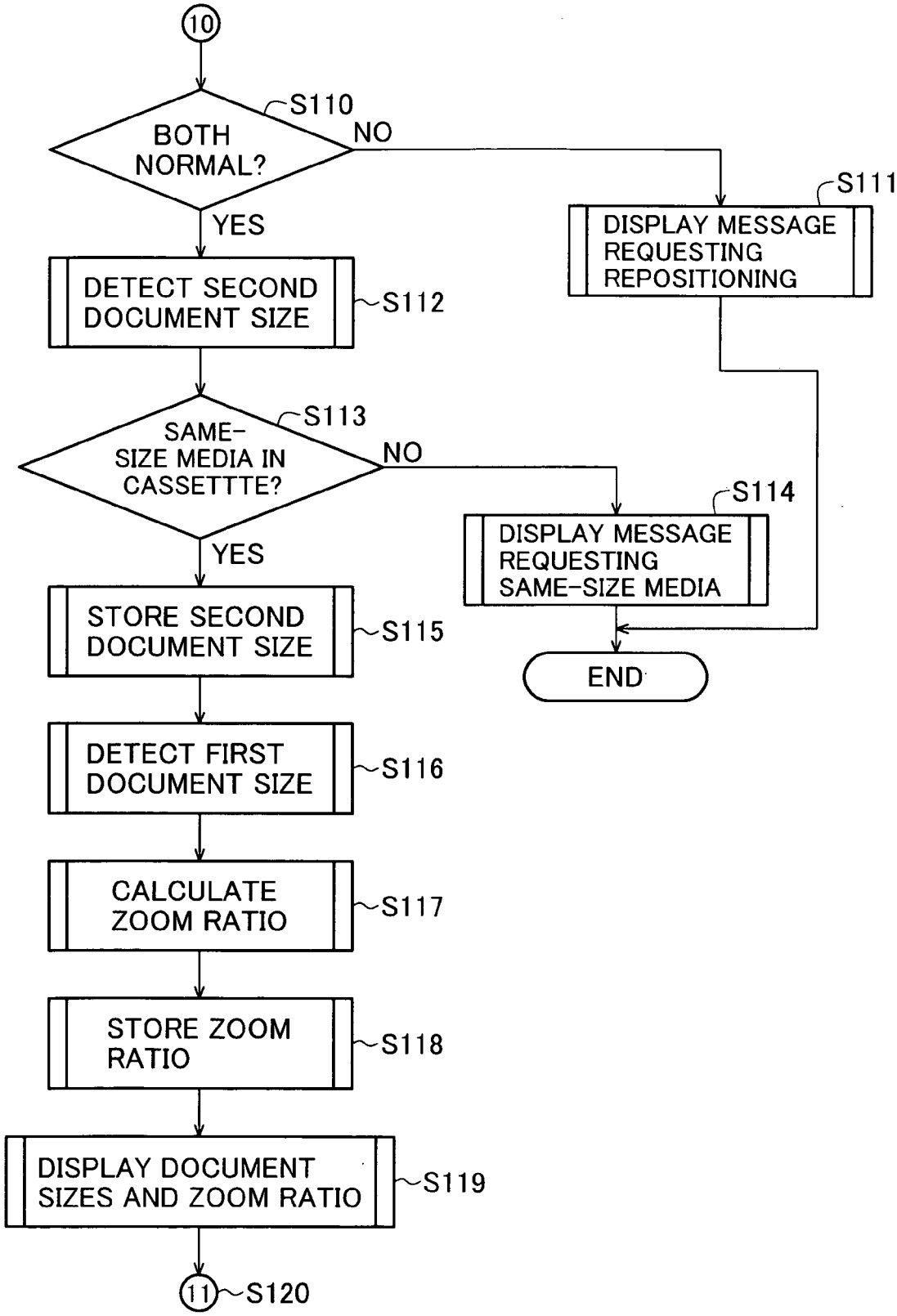
Figure 15C:
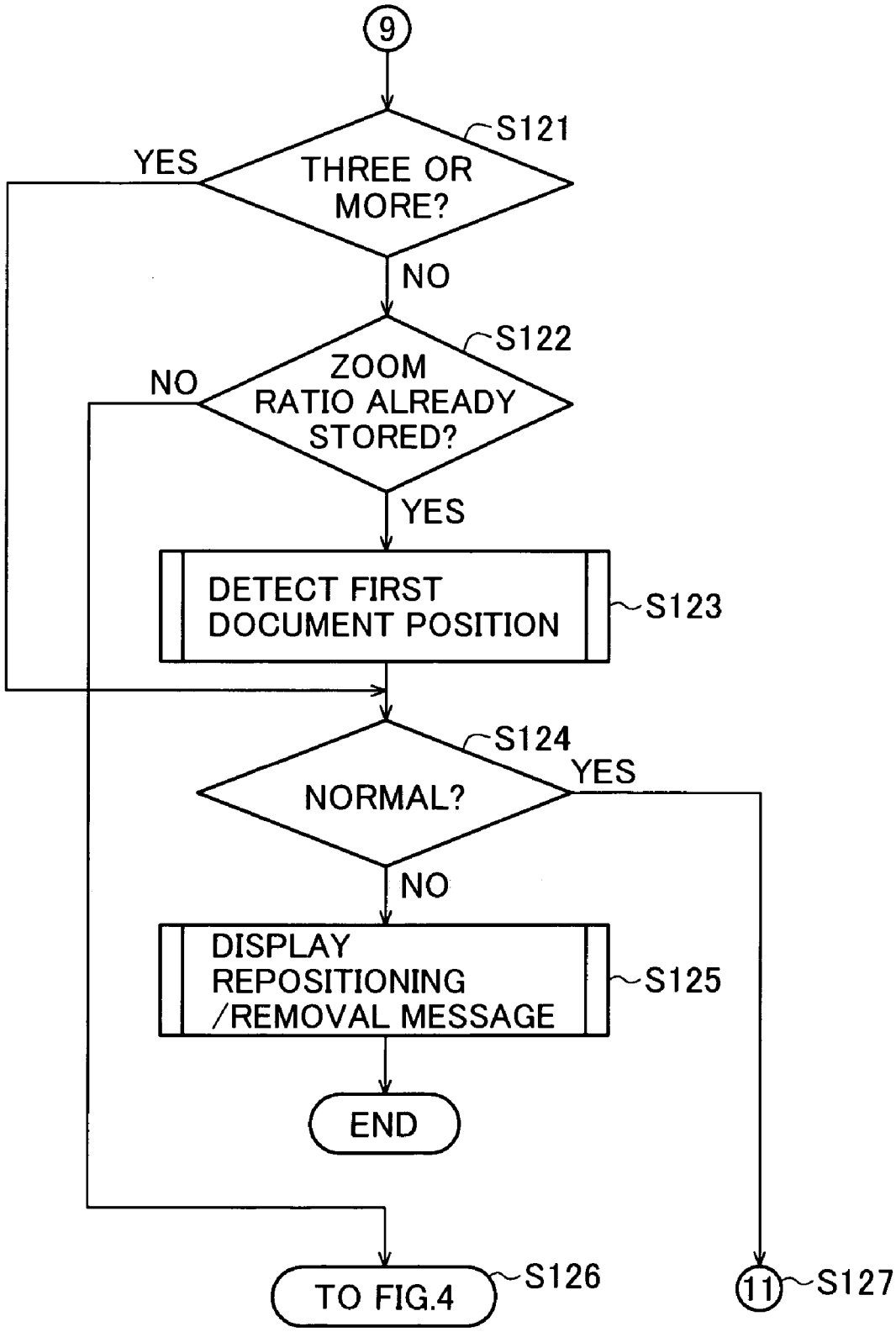

The above-described procedure is illustrated in the flowchart in FIGS. 15A to 15C. In step S101 in FIG. 15A, an indication that the image processing apparatus 10 is in the standby state is displayed. Next, the presence or absence of a document on the document table is sensed in step S102 to determine in step S103 whether a document is present. If no document is detected, the key states on the control panel are scanned in step S104 to determine in step S105 whether any key is down. If a key is down, processing for the key that is down is performed in step S106; otherwise, the process returns to step S102 above. If a document is detected, the number of documents is detected in step S107 to determine in step S108 whether two documents are present. If there are two documents, the positions of the two documents are detected in step S109, but if there is only one document, or three or more documents, the process proceeds to step S121 in FIG. 15C.

Following step S109, whether the two documents are placed in accordance with the predetermined reference positions is determined in step S110 in FIG. 15B. If the two documents are not placed in accordance with the predetermined reference positions, a message requesting repositioning of the first document 61-1, the second document 61-3, or both document is displayed on the display unit 14-2 in step S111, and the process ends. If both documents are placed in accordance with the predetermined reference positions, the size of the second document 61-3 is detected in step S112, and whether recording media of the same size as the second document 61-3 are loaded in the cassette is determined in step S113. If such recording media are not present in the cassette, a message requesting loading of media of the same size as the second document 61-3 is displayed on the display unit 14-2 in step S114, and the process ends. If recording media of the same size are already present in the cassette, the size of the second document 61-3 is stored in the media size area 17-5 in step S115. In step S116, the size of the first document 61-1 is detected, and a zoom ratio is calculated from the sizes of the first document 61-1 and second document 61-3 in step S117. The calculated zoom ratio is then stored in the zoom ratio area 17-4 in step S118 and displayed on the display unit 14-2 together with the sizes of the first document 61-1 and second document 61-3 in step S119 for the user to confirm, after which the process proceeds from step S120 to step S88 in FIG. 13B.

In step S121 in FIG. 15C, it is determined whether three or more documents are present or not. If there are three or more documents, a message requesting repositioning or removal of the documents is displayed on the display unit 14-2 in step S125, and the process ends. Otherwise, it is determined in step S122 whether a zoom ratio is already stored in the zoom ratio area 17-4. If no zoom ratio is already stored, the process proceeds from step S126 to step S1 in FIG. 4A. If a zoom ratio is already stored in the zoom ratio area 17-4, the position of the first document 61-1 is detected in step S123. In step S124, it is determined whether the first document 61-1 is placed in accordance with the predetermined reference position. If the first document 61-1 is placed in accordance with the predetermined reference position, the process proceeds from step S127 to step S88 in FIG. 13B; otherwise, the process ends after the message display in step S125.

Incidentally, if the process enters FIG. 13B from step S124 in FIG. 15C, then step S97 in FIG. 13B is modified to return to step S88 in FIG. 13B if only one document is present, and to step S71 in FIG. 13A if two or more documents are present.

As described above, according to the sixth embodiment, the second document 61-3 is not required when the second and subsequent pages of the first document 61-1 are scanned. Therefore, for the second and subsequent pages, the same effects as in the fifth embodiment can be obtained by placing each page by itself on the document table, as in the conventional art. When multiple pages of a document are scanned, the zooming operation can be simplified and the necessary time can be reduced accordingly.

Next, a seventh embodiment of the invention will be described. In the seventh embodiment, when the size of the first document 61-1 is zoomed to match the size of the second document 61-3 as described in the fifth embodiment, if the zoom ratio is 50% or 200%, the scanning resolution is halved or doubled.

Figure 16:
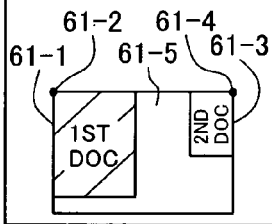
FIG. 16 shows an example of the selection of zoom modes according to document positions in a seventh embodiment.
Figure 16:
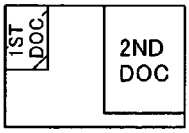

FIG. 16 shows examples of zooming modes with these ratios. The image processing apparatus 10 in the seventh embodiment selects both a zoom ratio and a scanning resolution according to the positions and sizes of the documents placed on the transparent table 61-5. In FIG. 16, the scanning resolution column 62-5 indicates how the scanning resolution is selected, depending on the document sizes and the scanning resolution that would be selected normally. Except for this column, FIG. 16 is identical to FIG. 12 in the fifth embodiment, so descriptions of the other columns will be omitted.

Two examples are shown in FIG. 16: the first example has an A4-size first document 61-1, an A6-size (105 millimeters×148 millimeters) second document 61-3, and a zoom ratio of 50%; the second example has an A6-size first document 61-1, an A4-size second document 61-3, and a zoom ratio of 200%. When the zoom ratio is 50%, the dot density in the main and sub scanning directions is halved. Therefore, a scanning resolution of 200 dpi is reduced to 100 dpi, for example, and 600 dpi is reduced to 300 dpi. When the zoom ratio is 200%, the dot density in the main and sub scanning directions is doubled. Therefore, a scanning resolution of 200 dpi is increased to 400 dpi, for example, and 600 dpi is increased to 1200 dpi.

Next, the operation of the image processing apparatus 10 in the seventh embodiment will be described. The operation described below is performed between steps S118 and S119 in the flowchart shown in FIG. 15B in the sixth embodiment.

First, zoom ratio information stored in the zoom ratio area 17-4 is read out to determine whether the zoom ratio is a 50% reduction or not. If the zoom ratio is a 50% reduction, the scanning resolution is halved, status information indicating that image processing for density conversion of the scanned image data is unnecessary is set, and the process ends.

If the zoom ratio is not a 50% reduction, it is then determined whether the zoom ratio is a 200% enlargement or not. If the zoom ratio is a 200% enlargement, the scanning resolution is doubled, status information indicating that image processing for density conversion of the scanned image data is unnecessary is set, and the process ends. Otherwise, status information indicating that image processing for density conversion of the scanned image data is necessary is set and the process ends. The information about the necessity or non-necessity of density conversion determines whether to perform image zooming processing or not.

Figure 17:
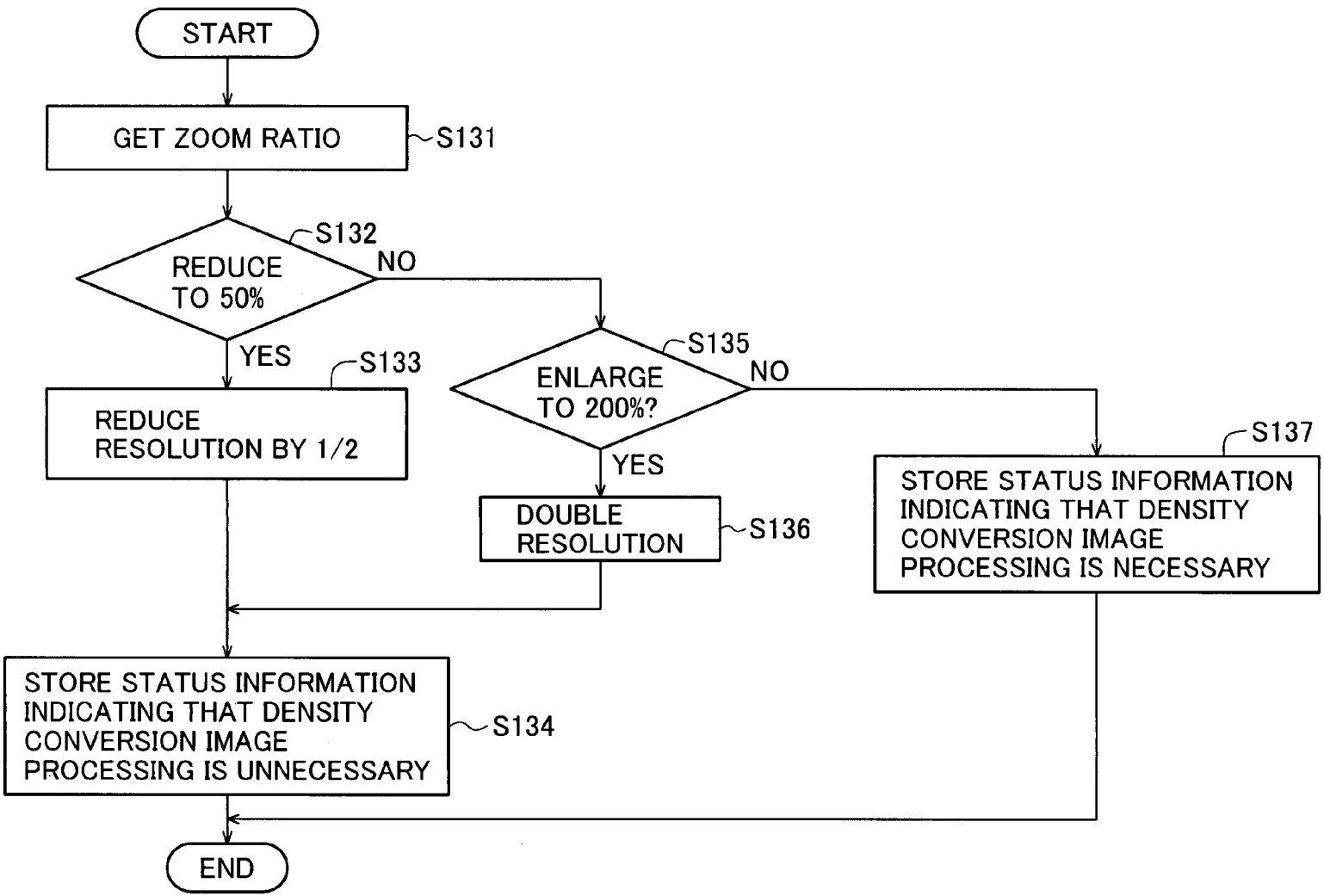
FIG. 17 is a flowchart illustrating the operation of the image processing apparatus in the seventh embodiment.

This procedure, which can be inserted between steps S118 and S119 in the flowchart shown in FIG. 15B in the sixth embodiment, is illustrated in the flowchart in FIG. 17. In step S131, the zoom ratio information stored in the zoom ratio area 17-4 is read out. In step S132, whether the zoom ratio is a 50% reduction or not is determined. If the zoom ratio is a 50% reduction, the scanning resolution is halved in step S133, status information indicating that density conversion of the scanned image data is unnecessary is set in step S134, and the process ends. Otherwise, whether the zoom ratio is a 200% enlargement or not is determined in step S135. If the zoom ratio is a 200% enlargement, the scanning resolution is doubled in step S136 and the process proceeds to step S134 to set status information indicating that density conversion is unnecessary; otherwise, status information indicating that density conversion of the scanned image data is necessary is set in step S137, after which the process ends.

As described above, in the seventh embodiment, the scanning resolution is converted according to the zoom ratio, if the zoom ratio is 50% or 200%. For these two zoom ratios, the zoom processing unit 52 does not have to process the scanned image data, so time is saved and power consumption is reduced.

Next, an eighth embodiment of the invention will be described with reference to FIGS. 18, 19A, and 19B.

In the first embodiment, the scanning and image processing modes were selected according to the position of a document 22-1 placed on the transparent table 22-2. In the eighth embodiment, the document 22-1 is placed on the document table of an ADF. This document table will also be referred to below as a document tray. The document sensing unit 15 in the eighth embodiment has sensors for sensing the presence of documents in the ADF document tray.

Figure 18:
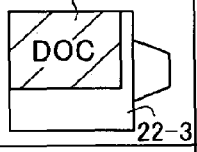
FIG. 18 shows an example of the selection of scanning modes and image processing modes according to document positions in an eighth embodiment.
Figure 18:
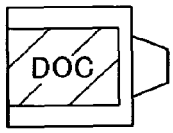
Figure 18:
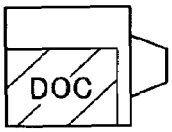
Figure 18:
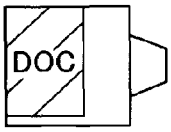

The predetermined positions of the document 22-1 on the document tray of the ADF 22-3 are illustrated in the document position column 22 in FIG. 18. It is assumed here that a paper feeding roller is disposed on the left side of the ADF 22-3. The document 22-1 is placed so that its left edge is in contact with the paper feeding roller unit. In document position pattern No. 1, for example, the document 22-1 is aligned at the reference position in the far left corner of the ADF 22-3 in the short edge feed orientation. The items selected in document position pattern No. 1, as shown in the mode selection column 23, include grayscale and a resolution of 300 dpi, so the selected scanning and image processing modes are 'grayscale with 300 dpi resolution'. In the other exemplary document positional patterns shown, the document 22-1 is placed in the center of the paper feeding path by adjusting the paper guide to the center, is aligned with the near left corner in the short edge feed orientation, and is aligned with the far left corner in the long edge feed orientation.

Next, the operation of the image processing apparatus 10 in the eighth embodiment will be described. Aside from the location of the document table, the initial steps from displaying an indication that the image processing apparatus 10 is in the standby state to deciding whether the start key is down or not are the same as in the first embodiment. If the start key is down, the document 22-1 is fed from the paper feeding roller position in the ADF 22-3 to the position where scanning is performed. The document 22-1 is then scanned by the document scanning unit 13 and ejected from the image processing apparatus 10. Next, if image processing is selected, it is performed as in the first embodiment, and the presence or absence of a document 22-1 is detected again. If a next document or a next page of the same document 22-1 is present on the document tray of the ADF 22-3, it is fed from the paper feeding roller position in the ADF 22-3 to the position where scanning is performed. Scanning continues in this way as long as a documents is detected on the document tray of the ADF 22-3. The processing ends when the document tray of the ADF 22-3 is empty.

There are two types of ADF mechanisms: one type feeds the document 22-1 onto a transparent document scanning table, where scanning is performed by a traveling scanning unit; in the other type, often used in facsimile machines, a fixed scanning unit scans the document 22-1 while the document is being fed. The image scanning control in the eighth embodiment is applicable to the either type of the ADF because the document position is detected when the document 22-1 is placed on the document tray of the ADF 22-3.

Figure 19A:
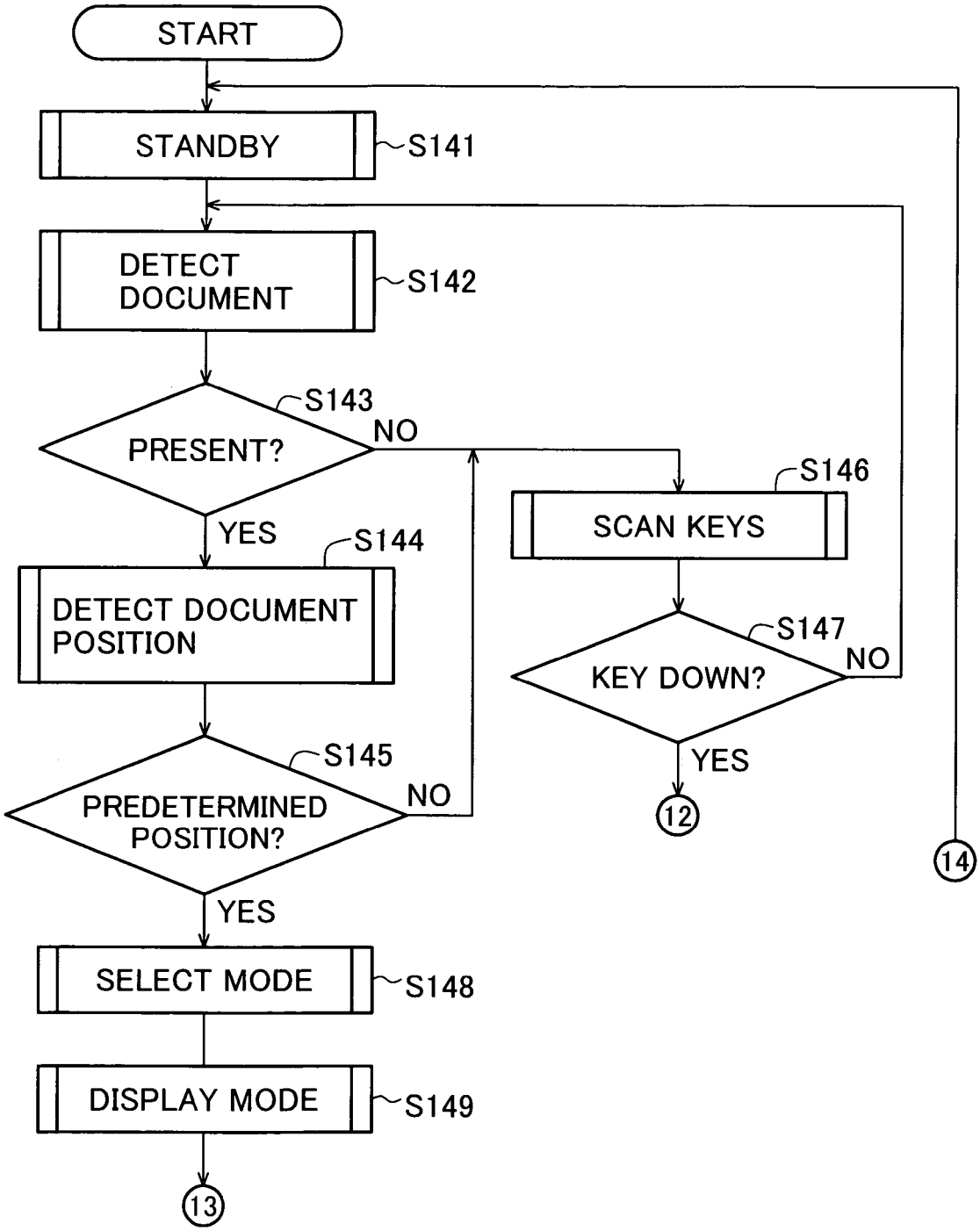
FIGS. 19A and 19B are a flowchart illustrating the operation of the image processing apparatus in the eighth embodiment.
Figure 19B:
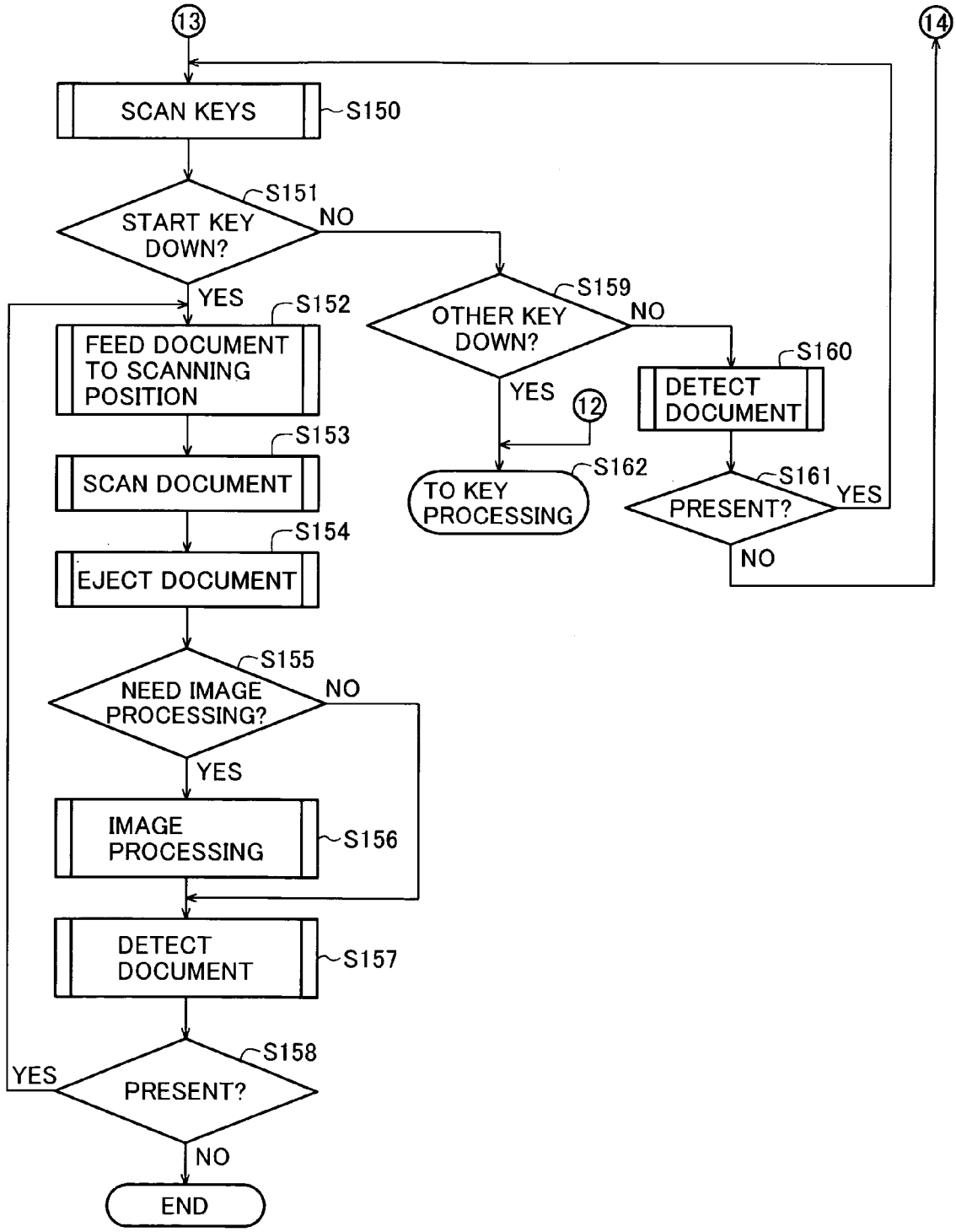

The entire procedure is illustrated in the flowchart in FIGS. 19A and 19B. In step S141 in FIG. 19A, an indication that the image processing apparatus 10 is in the standby state is displayed on the display unit 14-2. Next, the presence or absence of a document on the ADF document tray is sensed in step 142, and whether a document is present is determined in step S143. If a document 22-1 is present, its position is detected in step S144, and whether the document 22-1 is disposed in one of the predetermined positions is decided in step S145. If no document is present in step S143, or if the document position is not one of the predetermined positions in step S145, the key states on the control panel are scanned in step S146 to decide in step S147 whether any key is down. If a key is down, processing for the key that is down is performed in step S162 in FIG. 19B; otherwise, the process returns to step S142 in FIG. 19A. If the document 22-1 is detected at one of the predetermined positions in step S145, the scanning and image processing modes corresponding to the document position are selected in step S148 and displayed on the display unit 14-2 in step S149.

The key states on the control panel are then scanned in step S150 in FIG. 19B to determine in step S151 whether the start key is down. If the start key is down, the document 22-1 is fed in step S152 from the paper feeding roller position in the ADF 22-3 to the scanning position, scanning is performed in step S153, and the document is ejected in step S154. Whether image processing is necessary or not is determined in step S155, and if image processing is necessary, it is performed in step S156. Next, the presence or absence of another document on the document tray is sensed in step S157 to determine in step S158 whether a document is present. If a document 22-1 is present, the process returns to step S152 above; otherwise, the process ends. If the start key is not down in step S151, whether any other key is down or not is determined in step S159. If another key is down, processing for the key that is down is performed in step S162; otherwise, the presence or absence of a document on the document tray is sensed in step S160 to determine in step S161 whether a document is present or not. If a document 22-1 is present, the process returns to step S150; otherwise, the process returns to step S141 in FIG. 19A.

As described above, in the eighth embodiment, as in the first embodiment, since scanning modes and image processing modes are pre-assigned according to the position of the document 22-1 on the document tray of the ADF 22-3, the user does not have to set the scanning and image processing modes. The operation can be simplified and the necessary time can be reduced accordingly.

Next, a ninth embodiment of the invention will be described.

In the fifth embodiment, first and second documents are placed on the document tray and the first document is scanned and enlarged or reduced to the size of the second document. In the sixth embodiment, this method is modified by omitting the placing of the second document when the second and subsequent pages of the first document are scanned. In the ninth embodiment, the method of the sixth embodiment is further applied to an image processing apparatus 10 having both an ADF and a transparent (glass plate) document scanning table.

Figure 20:
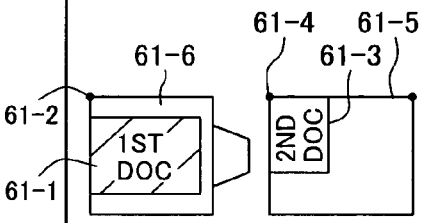
FIG. 20 shows an example of the selection of zoom modes according to document positions in a ninth embodiment.
Figure 20:
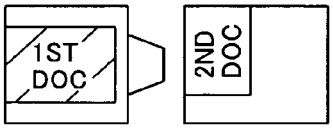
Figure 20:
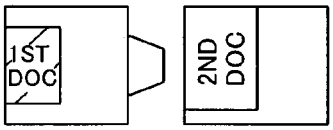

FIG. 20 shows examples of zoom modes selected according to document positions in the ninth embodiment. In the document position column 61 of the table in FIG. 20, the positions of a first document 61-1 placed on the document tray of the ADF 61-6 and a second document 61-3 placed on the transparent table 61-5 are illustrated. For example, when the first document 61-1 placed on the document tray of the ADF 61-6 is of A4 size and the second document 61-3 placed on the transparent table 61-5 is of the A5 size, a zoom mode is selected that reduces that A4 size to A5 size, with a zoom ratio of 70%.

Next, the operation of the image processing apparatus 10 in the ninth embodiment will be described.

The ninth embodiment differs from the fifth embodiment in that: the presence or absence of the first document 61-1 on the document tray of the ADF 61-6 and the presence or absence of the second document 61-3 on the transparent table 61-5 are detected separately; the size of the second document 61-3 on the transparent table 61-5 and the zoom ratio are stored in the memory unit 17; when the start key is depressed to start scanning, the second document 61-3 on the transparent table 61-5 is ejected from the position where scanning is performed; and pages of the first document 61-1 are repeatedly fed, scanned, and ejected until the ADF 61-6 is empty. The document sensing unit 15 in the ninth embodiment has sensors for sensing documents both on the transparent table 61-5 and on the document tray in the ADF 61-6.

First, an indication that the image processing apparatus 10 is in the standby state is displayed on the display unit 14-2. Next, the document presence detector 15-1 detects the presence or absence of a first document 61-1 on the document tray of the ADF 61-6. If no first document 61-1 is present, then the operation unit 14-1 scans the key states on the control panel. If no key is down, the document presence detector 15-1 detects the presence or absence of the first document 61-1 again. If a key is down, processing for the key that is down is performed.

If a first document 61-1 is present on the document tray of the ADF 61-6, then the presence or absence of a second document 61-3 on the transparent table 61-5 is detected. If no second document 61-3 is present, the same key scanning process is carried out as when no first document 61-1 is present. If a second document 61-3 is present, the document position detector 15-2 detects the positions of the two documents. If the first document 61-1 and second document 61-3 are not aligned with the predetermined reference positions, the process ends with the display of a message requesting repositioning of the documents. If the first document 61-1 and second document 61-3 are aligned with the predetermined reference positions, the document size detector 15-3 detects the size of the second document 61-3 to determine whether recording media of the same size as the second document 61-3 are present in the recording media cassette. If recording media of the same size as the second document 61-3 are not present, the process ends with the display of a message requesting loading of recording media the same size as the second document 61-3.

If recording media of the same size as the second document 61-3 are present, the size of the second document 61-3 is stored in the media size area 17-5 and the document size detector 15-3 detects the size of the first document 61-1. A zoom ratio is then calculated on the basis of the sizes of the first document 61-1 and second document 61-3, and the calculated zoom ratio is stored in the zoom ratio area 17-4. The sizes of the first document 61-1 and second document 61-3 and the zoom ratio are displayed on the display unit 14-2 for the user to confirm, and the operation unit 14-1 scans the key states on the control panel.

If the start key is not down but another key is down, processing for the key that is down is performed. If no key is down, the presence or absence of the first document 61-1 and the second document 61-3 are detected again. If the first document 61-1 or second document 61-3 has been removed, the process returns to the standby state. If both documents are still present, the operation unit 14-1 scans the key states on the control panel again.

If the start key is down, the second document 61-3 is ejected from the transparent table 61-5 and the first document 61-1 is fed from the document tray of the ADF 61-6 to the position on the transparent table 61-5 where scanning is performed. The first document 61-1 is scanned by the scanning unit 13, then ejected from the transparent table 61-5. If the zoom ratio is not 100%, the zoom processing unit 52 carries out the necessary image enlargement or reduction processing. The document presence detector 15-1 detects the presence or absence of another page of the first document 61-1 on the document tray of the ADF 61-6. If present, the next page of the first document 61-1 is fed to the scanning position on the transparent table; otherwise, the process ends.

Figure 21A:
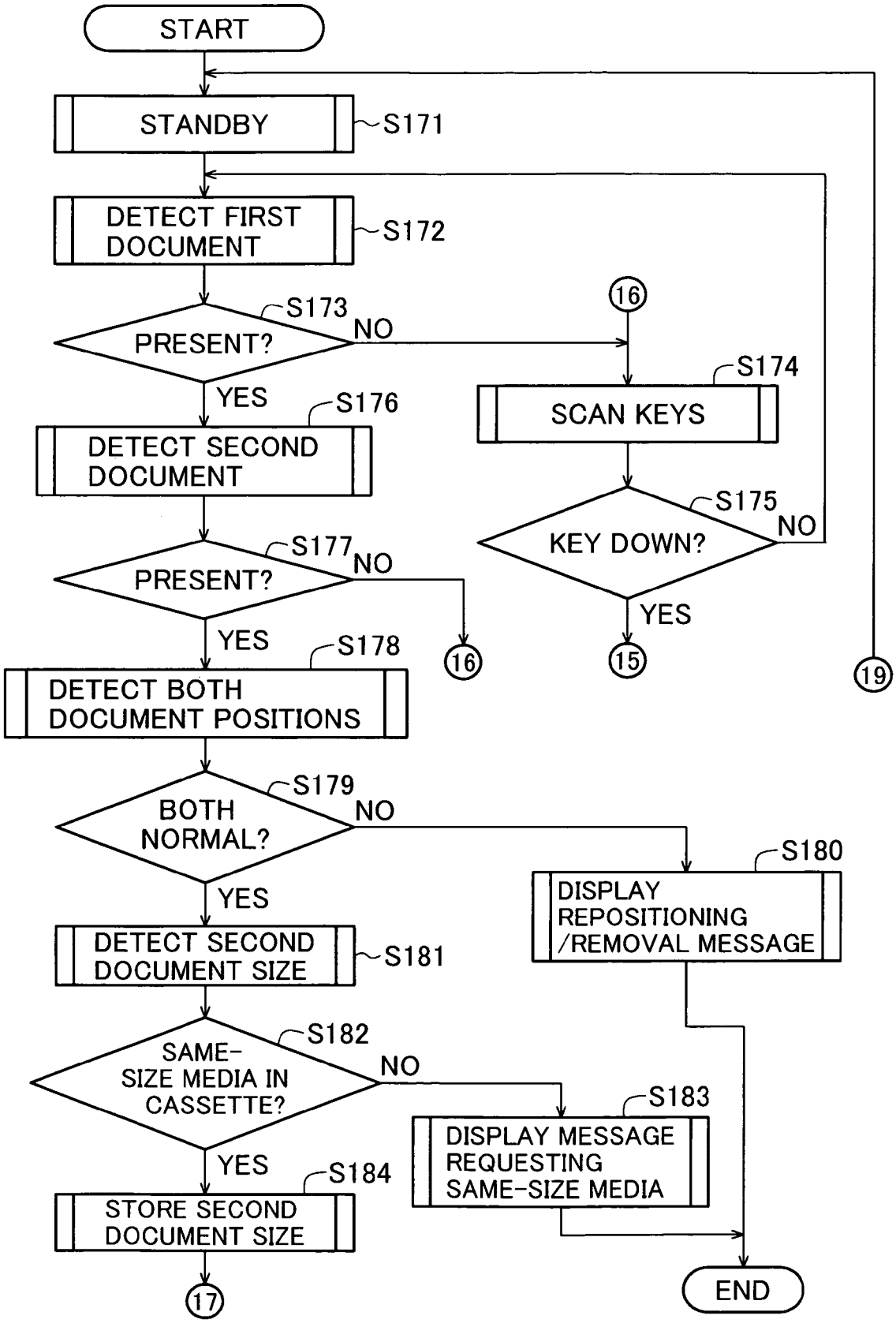
FIGS. 21A, 21B, and 21C are a flowchart illustrating the operation of the image processing apparatus in the ninth embodiment.
Figure 21B:
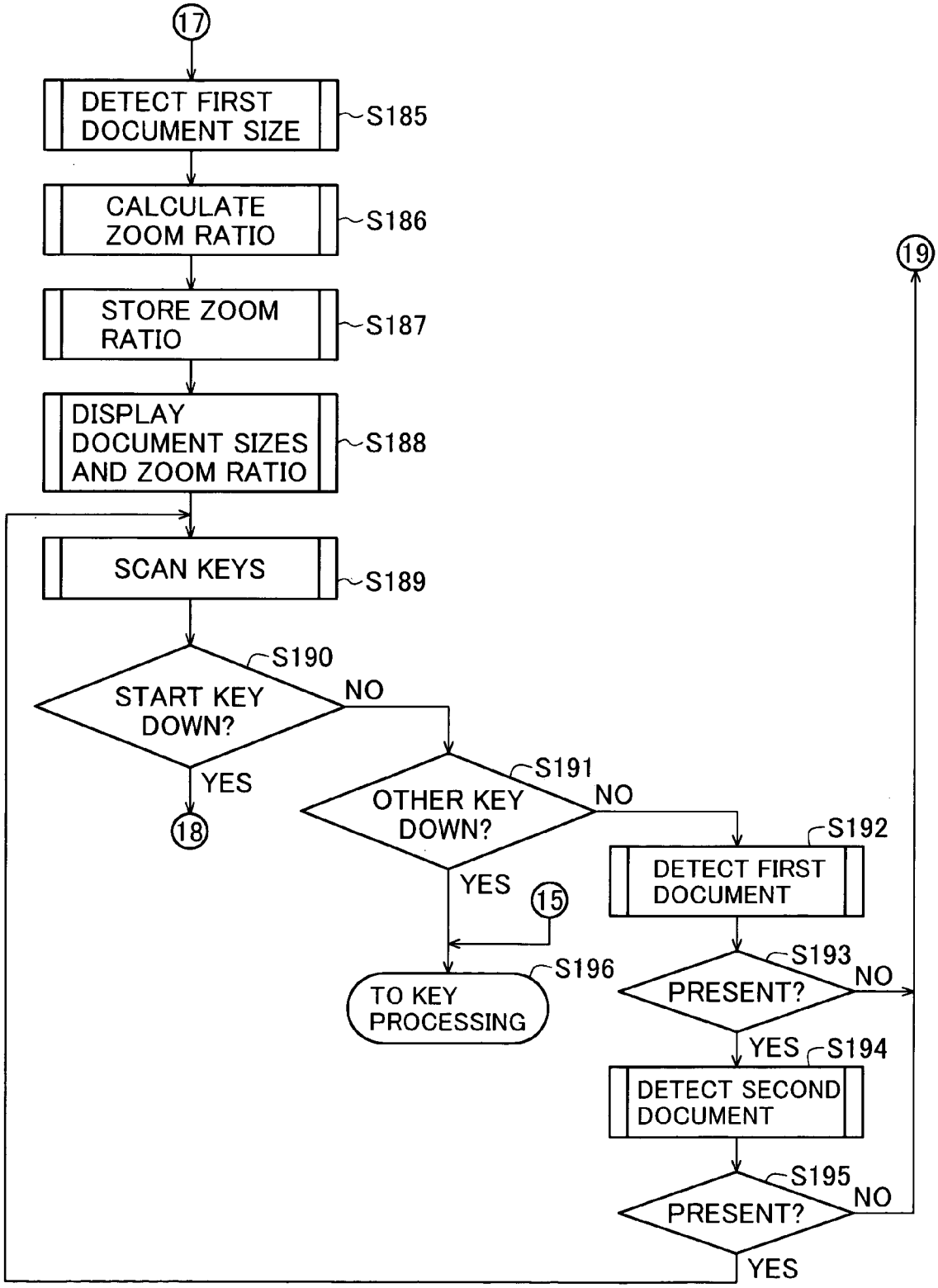
Figure 21C:
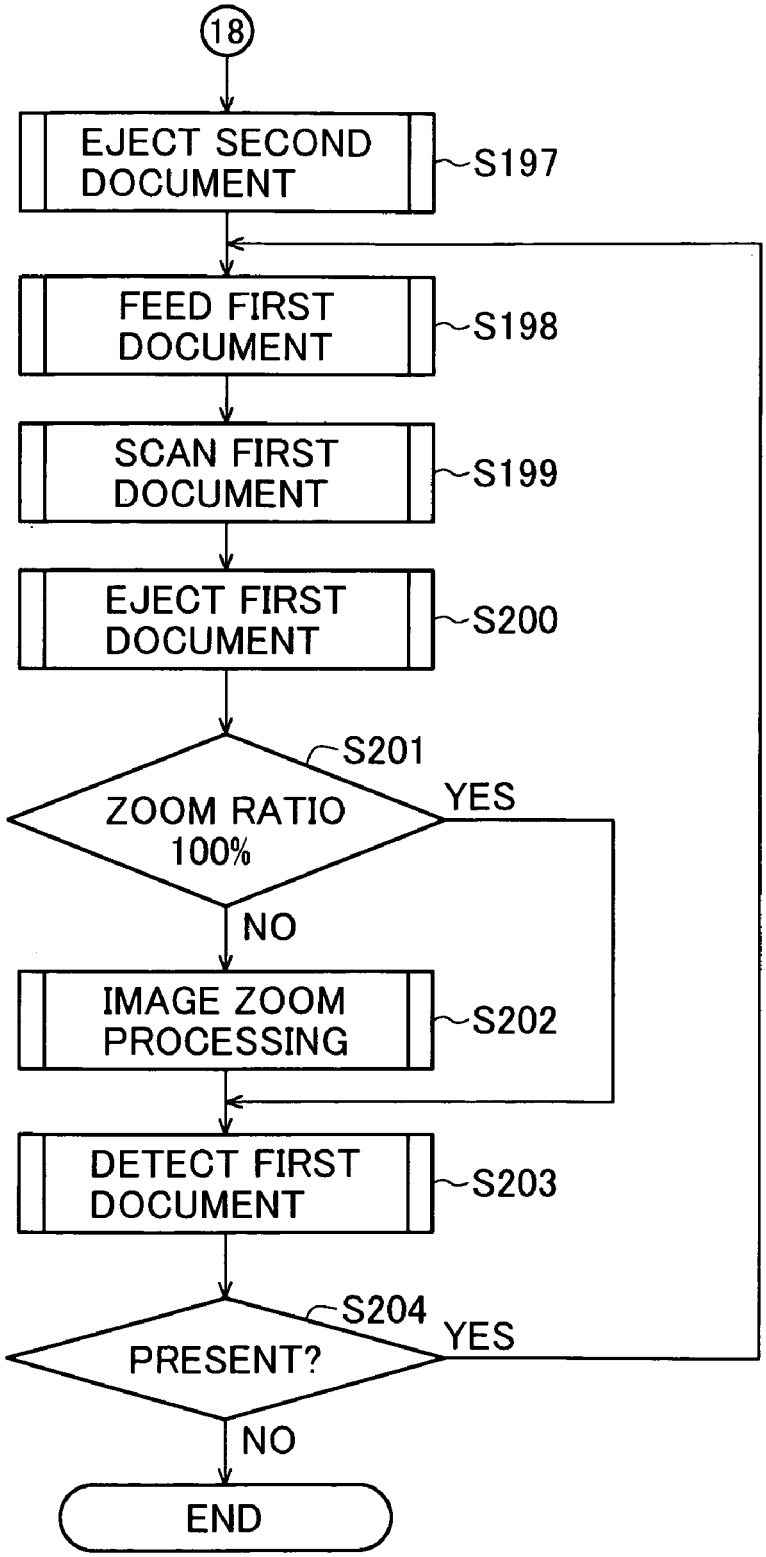

This procedure is illustrated in the flowchart in FIGS. 21A to 21C. In step S171 in FIG. 21A, an indication that the image processing apparatus 10 is in the standby state is displayed. Next, the presence or absence of a first document on the document tray of the ADF 61-6 is sensed in step S172 to determine in step S173 whether a first document is present. If no first document is present in the ADF document tray, the key states on the control panel are scanned in step S174 to determine in step S175 whether any key is down. If a key is down, processing for the key that is down is performed in step S196 in FIG. 21B; otherwise, the process returns to step S172 in FIG. 21A. If a first document 61-1 is present in the ADF document tray, the presence or absence of a second document on the transparent table 61-5 is sensed in step S176 to determine in step S177 whether a second document is present. If no second document is present on the transparent table 61-5, steps S174 and S175 are carried out as described above. If a second document 61-3 is present, the positions of the first and second documents are detected in step S178, and whether the two documents are placed in accordance with the predetermined reference positions is determined in step S179. If either document is out of position, a message requesting repositioning of the documents is displayed on the display unit 14-2 in step S180, and the process ends. If both documents are placed in accordance with the predetermined reference positions, the size of the second document 61-3 is detected in step S181. The next step S182 determines whether recording media of the same size as the second document 61-3 are present in the recording media cassette. If they are not, a message requesting loading of recording media of the same size as the second document 61-3 into the cassette is displayed on the display unit 14-2 in step S183, and the process ends. If recording media of the same size as the second document 61-3 are present, the size of the second document 61-3 is stored in the media size area 17-5 in step S184.

Following step S184, the size of the first document 61-1 is detected in step S185 in FIG. 21B, and a zoom ratio is calculated from the sizes of the first document 61-1 and second document 61-3 in step S186. The calculated zoom ratio is stored in the zoom ratio area 17-4 in step S187. In step S188, the sizes of the first document 61-1 and second document 61-3 and the zoom ratio are displayed on the display unit 14-2 for the user to confirm. In step S189, the key states on the control panel are scanned to determine in step S190 whether the start key is down. If the start key is down, the second document 61-3 on the transparent table 61-5 is ejected in step S197 in FIG. 21C. Otherwise, whether any other key is down is determined in step S191 in FIG. 21B. If another key is down, processing for the key that is down is performed in step S196. Otherwise, the presence of the first document on the document tray of the ADF 61-6 is sensed again in step S192 to determine in step S193 whether the first document 61-1 is still present. If the first document 61-1 has been removed, the process returns to step S171 in FIG. 21A. If the first document 61-1 is still present, the presence of the second document 61-3 on the transparent table 61-5 is sensed in step S194 in FIG. 21B. If the second document 61-3 is present, as determined in step S195, the process returns to step S189 above; otherwise, the process returns to step S171 in FIG. 21A.

Following the ejection of the second document in step S197 in FIG. 21C, in step S198, the first document 61-1 is fed from the document tray of the ADF 61-6 to the scanning position on the transparent table 61-5. The first document 61-1 is then scanned in step S199 and ejected in step S200. Whether the zoom ratio is 100% or not is determined in step S201, and if the zoom ratio differs from 100%, image zooming processing is performed in step S202. After step S201 or S202, the presence or absence of another page of the first document on the document tray of the ADF 61-1 is sensed in step S203 to determine in step S204 whether such a page is present. If another page of the first document 61-1 is present, the process returns to step S198 above; otherwise, the process ends.

As described above, in the ninth embodiment, the first document 61-1 is loaded into the ADF 61-6 and is zoomed to the size of a second document 61-3 placed on the transparent table 61-5. Therefore, when a document with multiple pages is scanned, the operation can be simplified and the necessary time can be reduced accordingly. Furthermore, since the pages of the document to be scanned can be loaded together into the ADF 61-6, the user is relieved from the inconvenience of changing documents once per page, which is necessary when two documents are placed on the transparent table 61-5 as in the sixth embodiment.

In the first to ninth embodiments, the image processing apparatus 10 has been described as a multipurpose device capable of scanning, printing, and copying documents, but the present invention is also applicable to a single-purpose device such as a scanner, a facsimile machine, or a copier. In particular, the image processing apparatus 10 need not have a printing unit, and if the printing unit is present, it may be housed separately from the scanning unit, instead of being integrated within the same housing as the scanning unit.

In the first to fourth embodiments and the eighth embodiment, if the device has both a transparent document scanning table and an ADF, the scanning and image processing mode may be selected according to the document position regardless of whether the document is placed on the transparent table or in the ADF document tray.

The invention is not limited to image processing apparatus having all of the scanning and image processing modes shown in the embodiments. For example, the invention can be practiced in monochrome image processing apparatus.

Those skilled in the art will recognize that further variations are possible within the scope of the invention, which is defined in the appended claims.

What is claimed is:

1. An image processing apparatus having a document table and a scanning unit for scanning a document placed on the document table, comprising:

a document position detector for detecting a position of the document on the document table;

an operating mode memory area storing a plurality of operating modes corresponding to different positions of the document on the document table; and a mode selector for selecting one of the operating modes stored in the operating mode memory area according to the position detected by the document position detector;

wherein the image processing apparatus scans the document and operates in the mode selected by the mode selector.

2. The image processing apparatus of claim 1, wherein the document table is a transparent table through which the scanning unit scans the document.

3. The image processing apparatus of claim 1, further comprising an automatic document feeder, wherein the document table is a tray in the automatic document feeder.

4. The image processing apparatus of claim 1, further comprising a display unit for displaying the operating mode selected by the mode selector.

5. The image processing apparatus of claim 1, further comprising an image printing unit for printing an image of the scanned document in the operating mode selected by the mode selector.

6. The image processing apparatus of claim 1, wherein the mode selector selects a scanning mode as said operating mode and the scanning unit scans the document in the scanning mode selected by the mode selector.

7. The image processing apparatus of claim 1, further comprising an image processing unit for processing an image of the document obtained by the scanning unit, wherein the mode selector selects an image processing mode as said operating mode and the image processing unit processes said image in the image processing mode selected by the mode selector.

8. The image processing apparatus of claim 7, wherein the mode selector also selects a scanning mode as said operating mode and the scanning unit scans the document in the scanning mode selected by the mode selector.

9. The image processing apparatus of claim 1, further comprising a zoom processing unit for reducing and enlarging an image of the document obtained by the scanning unit, wherein the mode selector selects a zoom ratio as said operating mode and the zoom processing unit enlarges or reduces said image according to the zoom ratio selected by the mode selector.

10. The image processing apparatus of claim 9, wherein the mode selector also selects a scanning resolution according to the zoom ratio, and the scanning unit scans the document at the resolution selected by the mode selector.

11. The image processing apparatus of claim 1, further comprising:

a first memory area for storing information specifying different operating modes corresponding to different positions detectable by the document position detector; and an operation unit for altering said information, thereby altering the operating modes selected, in response to detection of the different positions, by the mode selector.

12. The image processing apparatus of claim 11, wherein the first memory area comprises:

a first table of predetermined operating modes; and a second table of said different positions; wherein the operation unit receives input from a user of the image processing apparatus and assigns selectable ones of the predetermined operating modes to said different positions according to said input by storing data in the second table indicating entries in the first table.

13. The image processing apparatus of claim 11, wherein the first memory area comprises:

a first table for storing information defining the different operating modes; and a second table of said different positions; wherein the operation unit receives input from a user of the image processing apparatus, stores the information defining the different operating modes in the first table according to said input, and stores data in the second table indicating entries in the first table according to said input.

14. The image processing apparatus of claim 11, further comprising:

a second memory area for storing a password; and a control unit for comparing the stored password with an input password input by a user of the image processing apparatus, and permitting the operation unit to alter said information only if the input password matches the stored password.

15. The image processing apparatus of claim 1, wherein the document position detector detects long sides and short sides of the document.

16. The image processing apparatus of claim 1, wherein the operating mode selected by the mode selector is a color representation mode.

* * * * *